US006747537B1

(12) United States Patent
Mosteller

(10) Patent No.: US 6,747,537 B1
(45) Date of Patent: Jun. 8, 2004

(54) STRIP MAGNETS WITH NOTCHES

(75) Inventor: Larry A. Mosteller, Maineville, OH (US)

(73) Assignee: Magnet Technology, Inc., Lebanon, OH (US)

( * ) Notice: Subject to any disclaimer, the term of this patent is extended or adjusted under 35 U.S.C. 154(b) by 58 days.

(21) Appl. No.: 10/157,532

(22) Filed: May 29, 2002

(51) Int. Cl.[7] ..... H01F 7/02
(52) U.S. Cl. ..... 335/306; 335/302
(58) Field of Search ..... 335/302–306; 40/600; 210/222

(56) References Cited

U.S. PATENT DOCUMENTS

| | | | | | |
|---|---|---|---|---|---|
| 1,861,059 | A | * | 5/1932 | Johnson | 310/211 |
| 3,153,177 | A | * | 10/1964 | McFadyen | 335/285 |
| 5,161,344 | A | | 11/1992 | Kahonen | |
| 5,258,735 | A | * | 11/1993 | Allwine, Jr. | 335/306 |
| 5,825,271 | A | * | 10/1998 | Hu | 335/285 |
| 6,356,177 | B1 | * | 3/2002 | Ogura et al. | 335/306 |

OTHER PUBLICATIONS

Manufacturing drawings for various magnets previously sold by Magnet Technology, Inc., 7 pages, (no date).

* cited by examiner

*Primary Examiner*—Lincoln Donovan
(74) *Attorney, Agent, or Firm*—Frederick H. Gribbell

(57) ABSTRACT

A set of holding magnets is provided that exhibit shaped edges or surfaces that provide some extra mechanical strength to aid in improving upon the shear force resistance capabilities while in a holding relationship. In one embodiment, the longitudinal edge of one magnet is notched (or grooved) while its mating magnet exhibits a protrusion along one of its longitudinal edges. When the magnets are brought together so that the protrusion is inserted at least part-way into the notch, the two magnets will hold together using both magnetic and mechanical properties to advantage. The holding relationship will exhibit an increased shear force resistance that otherwise would entirely depend upon the magnetic strength to prevent a shear force from pulling the two magnets apart. In a second embodiment, the planar top surface of one rectangular strip magnet is notched (or grooved) while its mating magnet exhibits a protrusion along one of its rectangular surfaces.

20 Claims, 19 Drawing Sheets

STRIP MAGNETS WITH NOTCHES

TECHNICAL FIELD

The present invention relates generally to permanent magnets and is particularly directed to strip magnets of the type which are used as holding magnets. The invention is specifically disclosed as pairs of strip magnets that exhibit increased shear force resistance by use of mechanical interlocking features, which provides additional holding capability.

BACKGROUND OF THE INVENTION

Holding magnets have been available for years, and some of these magnets are extruded into strips. In many applications, these strip magnets are permanently attached to a structure, and then pieces of the structure are mated together at these magnets so as to form a temporary structure, such as a display stand used in a store. The holding magnets can be mated along their wide planar surfaces, or in some instances can be mated along their relatively thin edges. The magnetic force exerted will depend upon the materials used, the amount of magnetization, and the overall dimensions and polarizations of the magnets themselves.

While the strip magnets used in the past are adequate for many applications, they could still be improved upon, especially with respect to preventing the structures from coming apart due to shear forces.

SUMMARY OF THE INVENTION

Accordingly, it is an advantage of the present invention to provide a set of strip holding magnets to have improved shear force capabilities.

It is another advantage of the present invention to provide a set of strip magnets that have shaped edges or surfaces that provide some extra mechanical strength to aid in improving upon the shear force resistance capabilities while holding together.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, a set of permanent magnets is provided, which comprises: a first substantially rectangular permanent magnet having a first substantially planar surface and a second, opposite substantially planar surface, a first edge, a second edge, a third edge, and a fourth edge which form a perimeter about the first and second surfaces; a second substantially rectangular permanent magnet having a third substantially planar surface and a fourth, opposite substantially planar surface, a fifth edge, a sixth edge, a seventh edge, and an eighth edge which form a perimeter about the third and fourth surfaces; the first magnet exhibiting at least one protrusion along at least a portion of the first edge; and the second magnet exhibiting at least one depression along at least a portion of the fifth edge; wherein the at least one protrusion and the at least one depression are sized and shaped so as to mechanically mate with one another when the first magnet is placed proximal to the second magnet in a manner that orients the first edge with the fifth edge.

In accordance with another aspect of the present invention, a set of permanent magnets is provided, which comprises: a first substantially rectangular permanent magnet having a first substantially planar surface and a second, opposite substantially planar surface, a first edge, a second edge, a third edge, and a fourth edge which form a perimeter about the first and second surfaces; a second substantially rectangular permanent magnet having a third substantially planar surface and a fourth, opposite substantially planar surface, a fifth edge, a sixth edge, a seventh edge, and an eighth edge which form a perimeter about the third and fourth surfaces; the first magnet exhibiting at least one protrusion along at least a portion of the first surface; and the second magnet exhibiting at least one depression along at least a portion of the third surface; wherein the at least one protrusion and the at least one depression are sized and shaped so as to mechanically mate with one another when the first magnet is placed proximal to the second magnet in a manner that orients the first surface with the third surface, thereby increasing a shear force capability of the set of permanent magnets.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
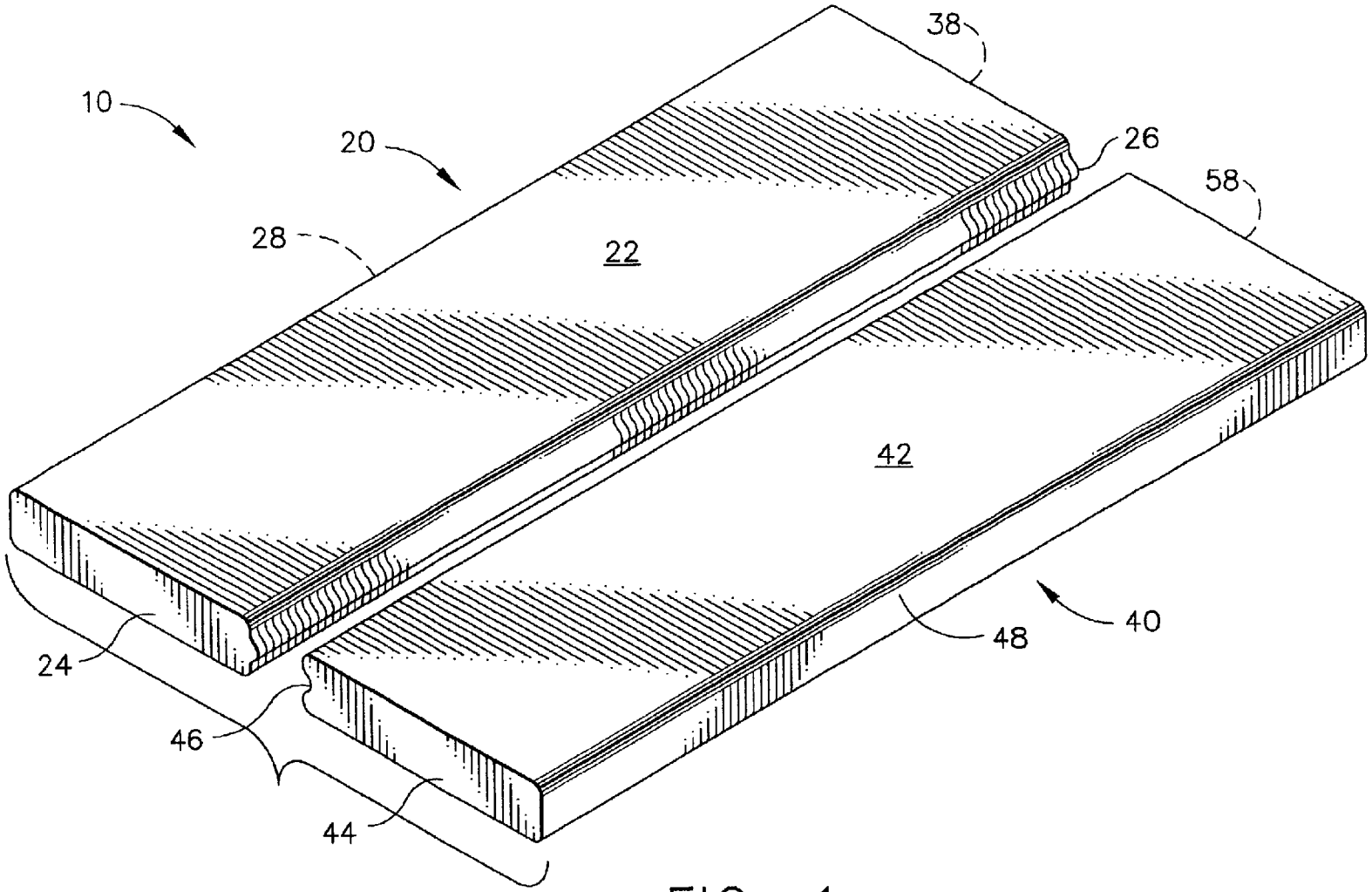
FIG. 1 is an isometric view of a strip magnet set, constructed in accordance with a first preferred embodiment of the present invention.

FIG. 1 shows a first embodiment of a strip magnet set, generally designated by the reference numeral 10, in which the two magnetic members are to be aligned with one another in an edge-to-edge configuration. In FIG. 1, the left-hand member is generally designated by the reference numeral 20, while the right-hand member is generally designated by the reference numeral 40.

The member 20 includes (in this view) an upper surface 22, a left end transverse edge 24, and a "near" longitudinal edge 26, a far longitudinal edge (not shown in this figure) at 28, and a right end transverse edge (not shown in this figure) at 38. As will be described below, the near edge 26 has a particular shape such that the edge exhibits a protrusion along virtually its entire length, and the protrusion is located virtually along its longitudinal centerline.

The member 40 includes (in the figure) a top surface 42, a left end transverse edge 44, a "near" longitudinal edge 48, a right end transverse edge (not shown in this figure) at 58, and a far longitudinal edge (not shown in this figure) at 46. The corner between the left end 44 and the far edge 46 can be seen in FIG. 1, and this illustrates the fact that the far longitudinal edge 46 exhibits an indentation that has the appearance of a smooth notch. This will be described in greater detail below. These edges 44, 46, 48, and 58 form a perimeter about the planar surface 42.

Figure 2:
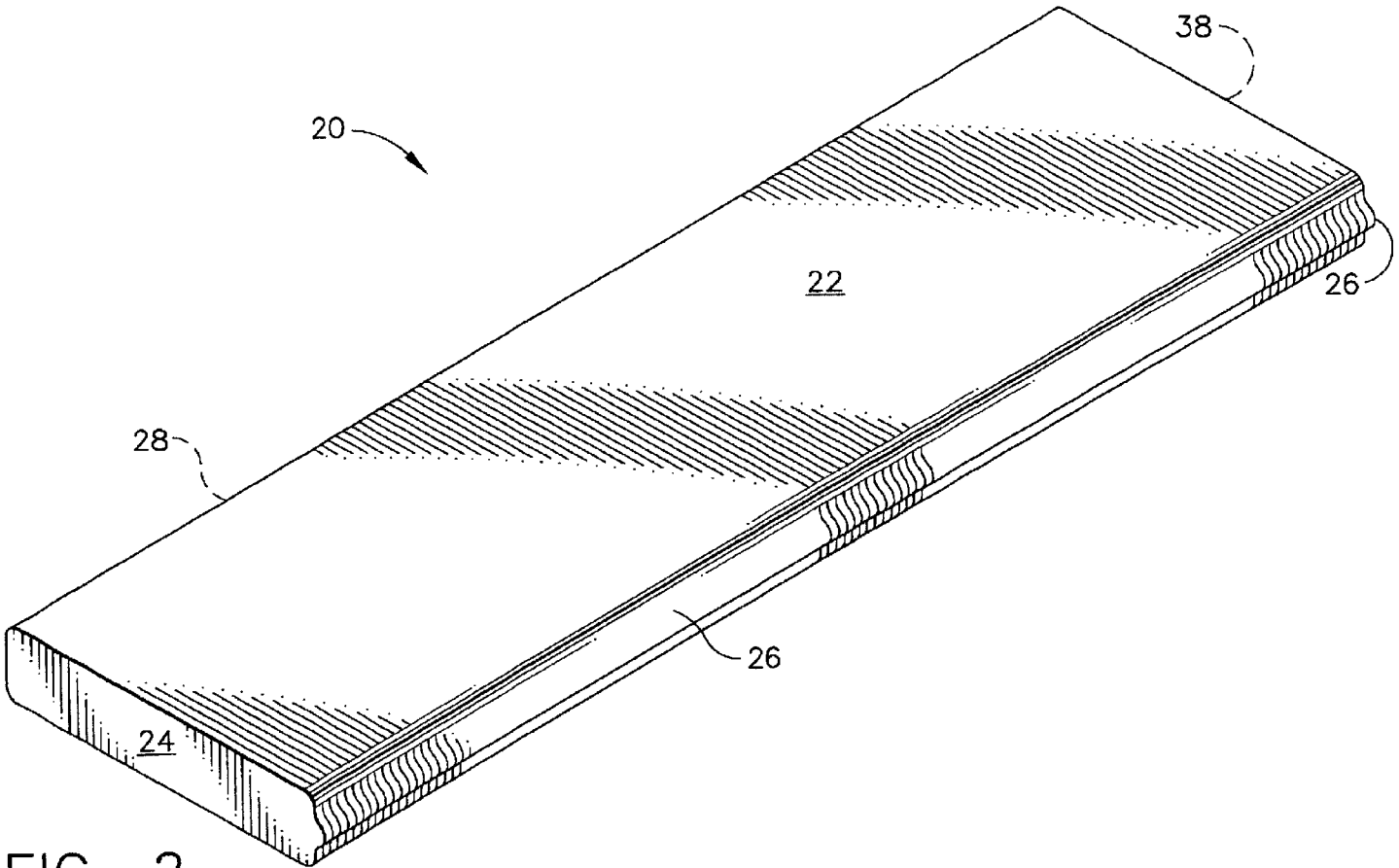
FIG. 2 is an isometric view of the left-hand member of the strip magnet set of FIG. 1, illustrating the shaped protrusion along one edge.

FIG. 2 shows the member 20 in somewhat greater detail, which again shows the top surface 22, the left end edge 24, the near longitudinal edge 26, and also indicates where the far longitudinal edge 28 and the right end edge 38 are located on this member 20. These edges 24, 26, 28, and 38 form a perimeter about the planar surface 22. As illustrated in FIG. 2, the protrusion along the near longitudinal edge 26 extends virtually along its entire length, and preferably has the same shape along the entire length, although the shape could be varied to achieve certain positional patterns, if desired. In general, the preferred shape of the protrusion will be such that it will mate against the preferred shape of the elongated notch of the other member 40. This will allow the two members 20 and 40 to mechanically mate with one another, and to assist in holding against one another and thereby acting as holding magnets.

The type of "interlocking" features of the protrusion and notch along the elongated edges of the members 20 and 40 are designed both to help keep the magnets in position while they are acting as holding magnets, but also to allow for quick release when the devices that are being held together are being manually disassembled. Moreover, these shapes help to guide the magnets 20 and 40 together in their correct positions as they are brought into close proximity to one another. The shapes of the protrusions and notches could certainly be varied while still performing their desired functions, and such variations are contemplated by the inventor and fall within the scope of the present invention.

Figure 3:
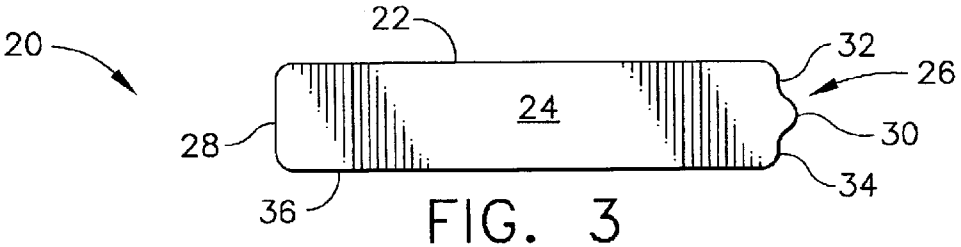
FIG. 3 is a left end view in elevation of the strip magnet of FIG. 2. The right end view is a mirror image of the left end view.

FIG. 3 illustrates the preferred shape of the protrusion along the edge 26. The "tip" of the protrusion is illustrated at 30, while the outer "shoulders" of the protrusion face (i.e., the longitudinal edge 26) are indicated at 32. The concave member of this shape is indicated at 34. As noted above, it will be understood that these preferred shapes can be easily modified without departing from the principles of the present invention.

In FIG. 3, the end edge 24 is directly facing the viewer, while the top surface 22 and a bottom surface 36 are indicated, along with the "near" edge 26 and the "far" edge 28.

Figure 4:
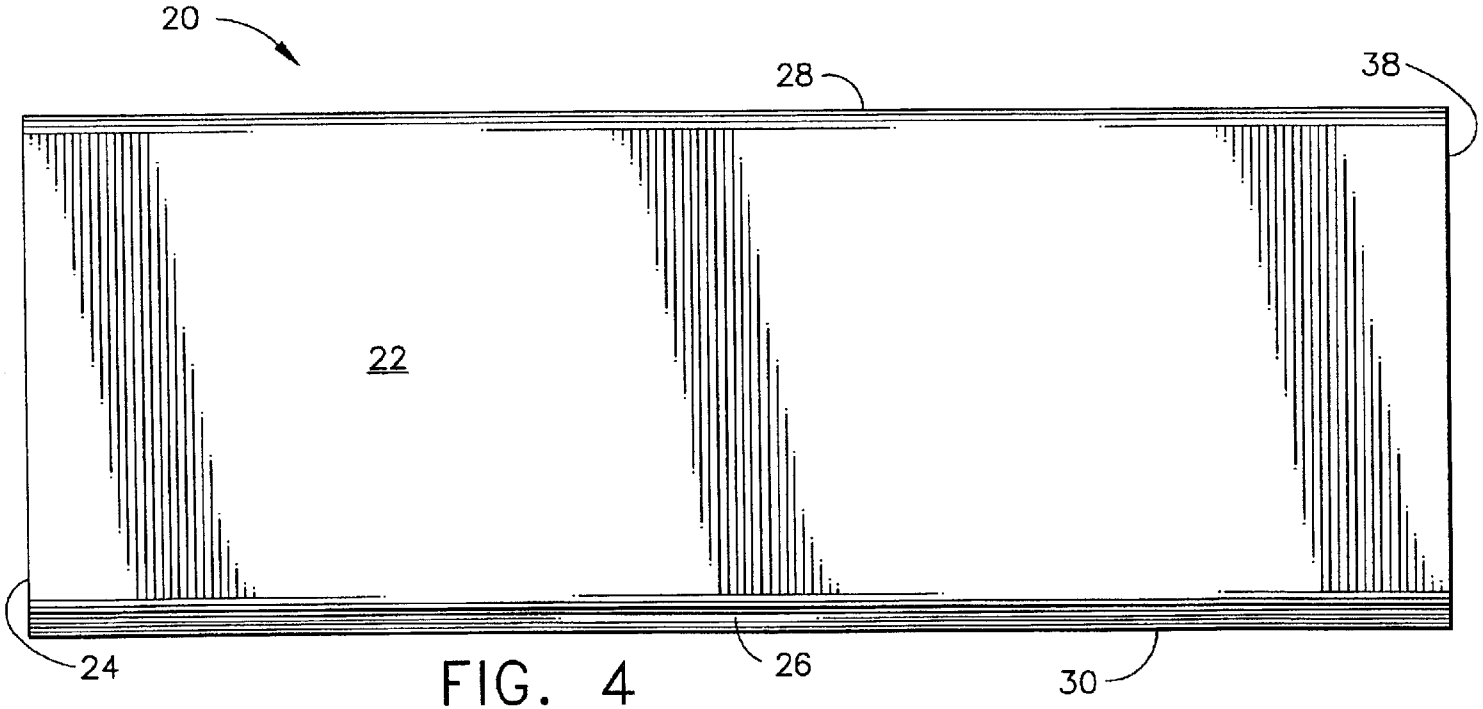
FIG. 4 is a top view of the strip magnet of FIG. 2. The bottom view is a mirror image of the top view.

FIG. 4 illustrates the top view of the member 20, and indicates that its upper surface 22 is essentially planar in nature. This of course could be changed, if desired, without departing from the principles of the present invention.

Figure 5:
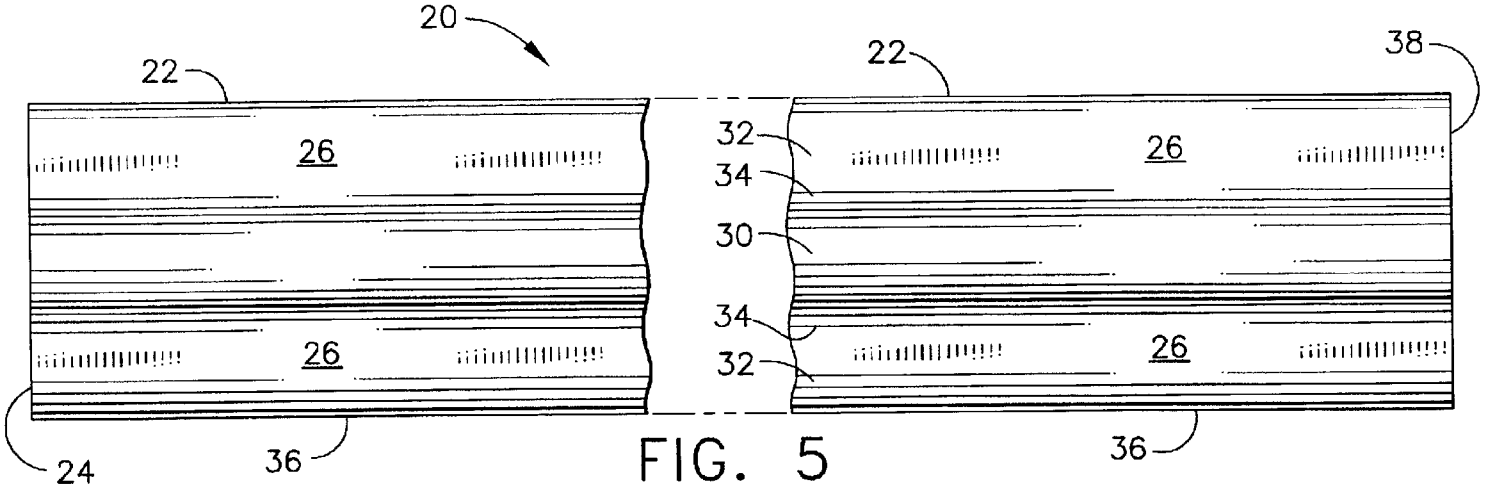
FIG. 5 is an enlarged front elevation view of the strip magnet of FIG. 2, illustrating the edge having the shaped protrusion.
Figure 6:
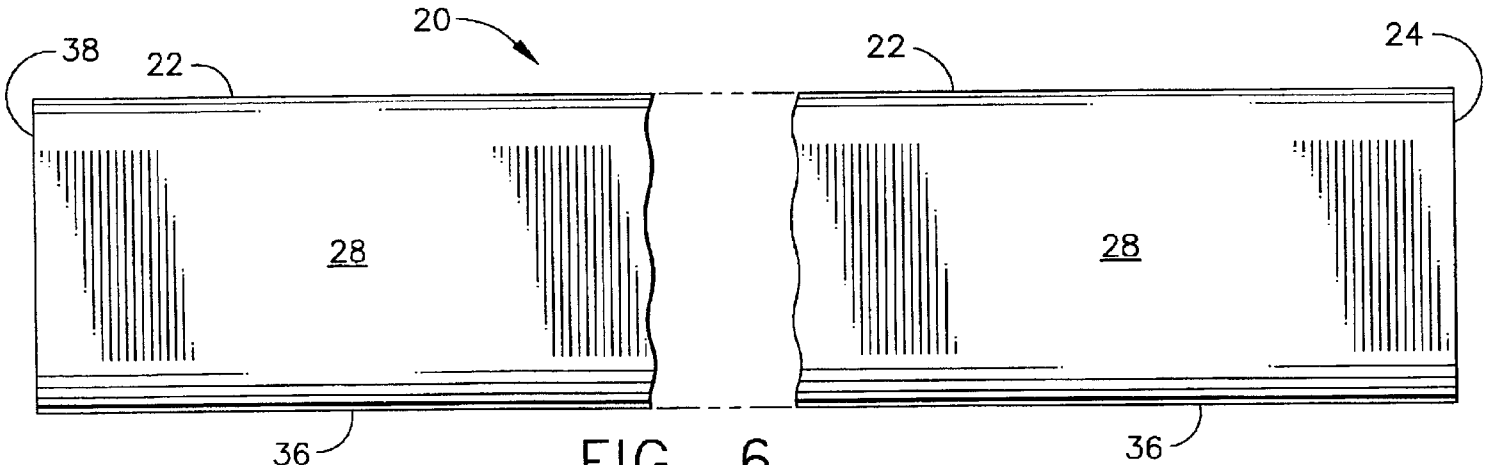
FIG. 6 is an enlarged rear elevation view of the strip magnet of FIG. 2.

FIG. 5 shows the same longitudinal edge 26 that exhibits the main protrusion 30, while FIG. 6 shows the opposite longitudinal edge 28 of the member 20. It will be understood that the opposite longitudinal edge 28 could also be shaped if desired (instead of being planar), although the keying effect of having only one edge "shaped" is also desirable.

Figure 7:
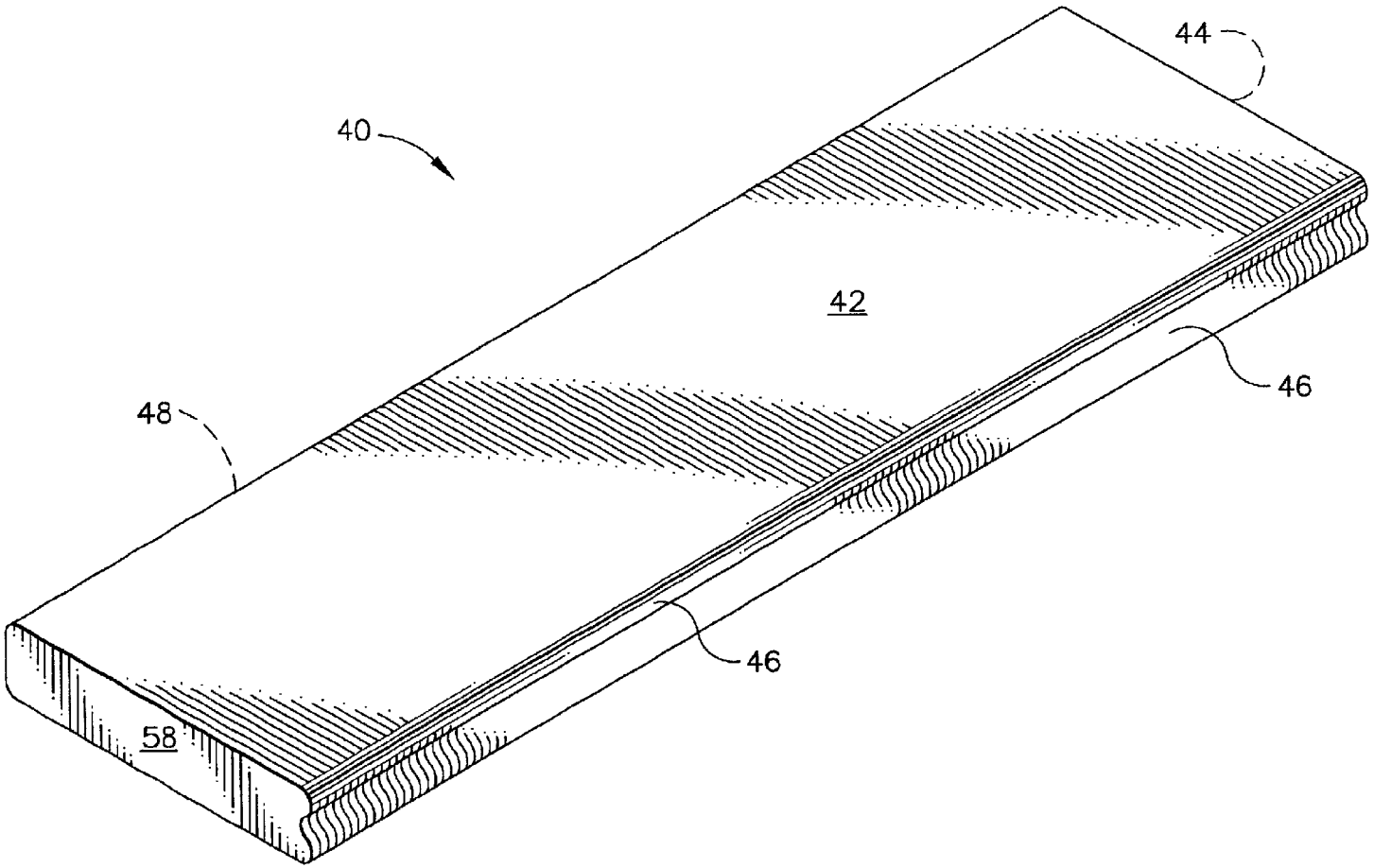
FIG. 7 is an isometric view of the right-hand member of the strip magnet set of FIG. 1, illustrating the shaped notch along one edge. The piece has been turned around for clarity.

FIG. 7 shows the member 40 in a somewhat enlarged view as compared to FIG. 1, and further shows this member 40 in an "opposite" orientation so that the longitudinal edge that exhibits the shaped notch can be seen. This notched longitudinal edge is designated by the reference numeral 46 and, as can be seen on FIG. 7, the notch essentially extends along the entire longitudinal edge 46. It is preferred that the notch extend substantially the entire length and, as seen in FIG. 7, this shape is substantially uniform throughout the entire length. Of course, the actual details of the shape of the notched edge 46 could be varied to provide various types of mechanical interlocking, if desired, without departing from the principles of the present invention. It will be understood that the "mechanical interlocking" that is generally desired is not meant to achieve a fully rigid connection that otherwise would be achieved if using true mechanical fasteners.

On FIG. 7, the upper surface 42 is clearly visible, along with the "left" end edge 58 (which was the right end edge on FIG. 1), as well as the notched edge 46. The "far" end edge 44 was previously the left end edge on FIG. 1 and was thereby visible, while the far longitudinal edge 48 is not visible on FIG. 7, but was visible on FIG. 1.

Figure 8:
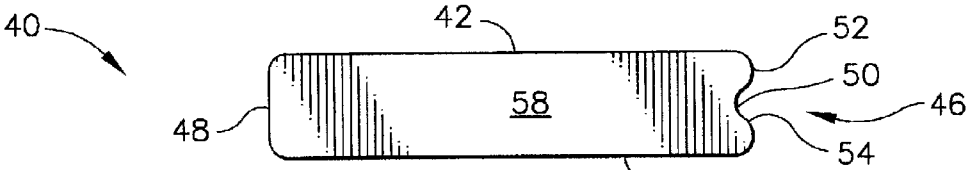
FIG. 8 is a left end view in elevation of the strip magnet of FIG. 7. The right end view is a mirror image of the left end view.

FIG. 8 is an end view in which the "left" end edge of FIG. 7 is facing the viewer, at 58. The upper surface 42 is indicated, as well as a lower surface 56. The longitudinal edge 48 is seen as being opposite from the notched longitudinal edge 46.

The shape of the longitudinal edge 46 is clearly visible in FIG. 8, and shows the most extreme indentation within the concave notch or depression at the reference numeral 50, while the two "shoulders" of the notch are visible as well. The "outer" shoulder is visible at 52, while the "inner" shoulder is visible at 54. It will be understood that the precise shape of this notched edge 46 can be varied without departing from the principles of the present invention. As noted above, it is preferred for this notched shape to continue along substantially the entire edge of the magnetic member 40, although this precise shape could be varied at predetermined distances along the edge, if desired to achieve certain purposes.

Figure 9:
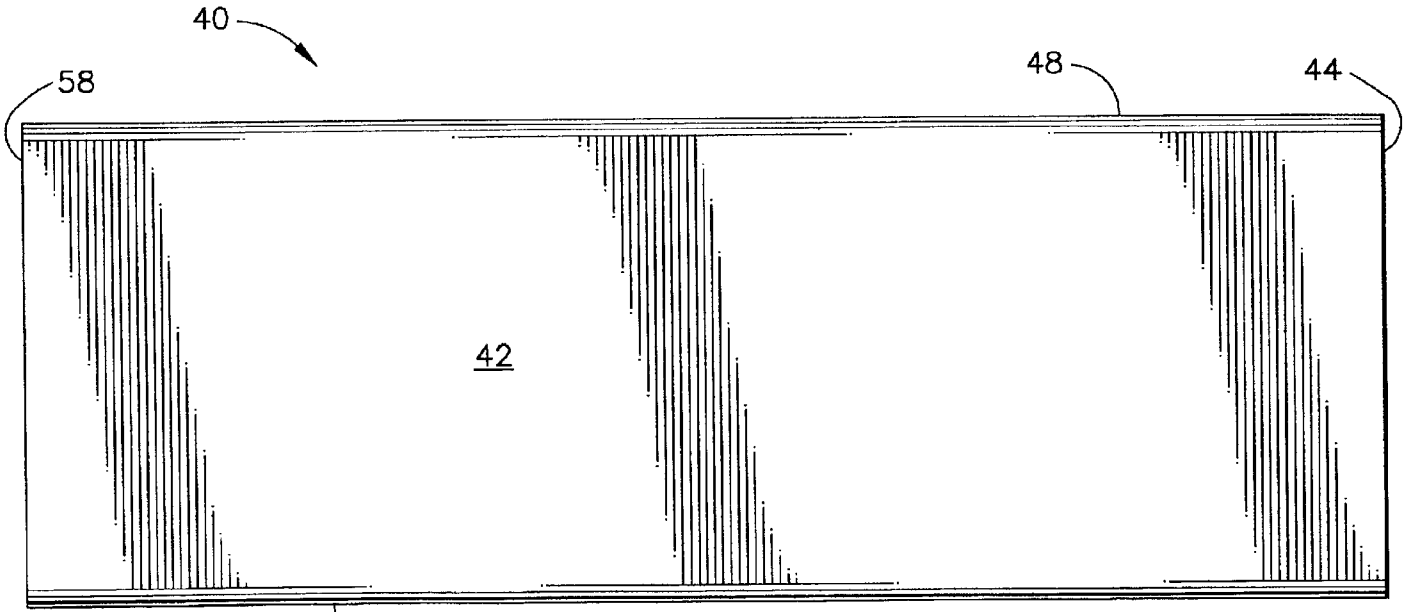
FIG. 9 is a top view of the strip magnet of FIG. 2. The bottom view is a mirror image of the top view.

FIG. 9 illustrates the upper surface 42 of the magnetic member 40, which as illustrated is preferably a planar surface. Of course, its exact shape does not necessarily have to be literally planar, although for this magnetic member to be extruded, a substantially planar surface is probably best.

Figure 10:
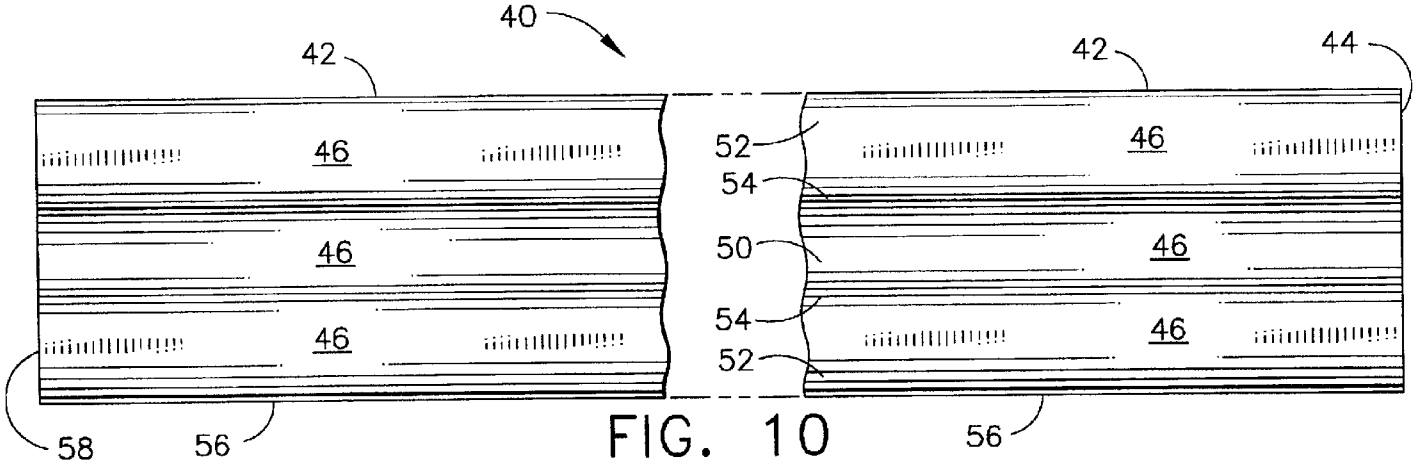
FIG. 10 is an enlarged front elevation view of the strip magnet of FIG. 7, illustrating the edge having the shaped notch.
Figure 11:
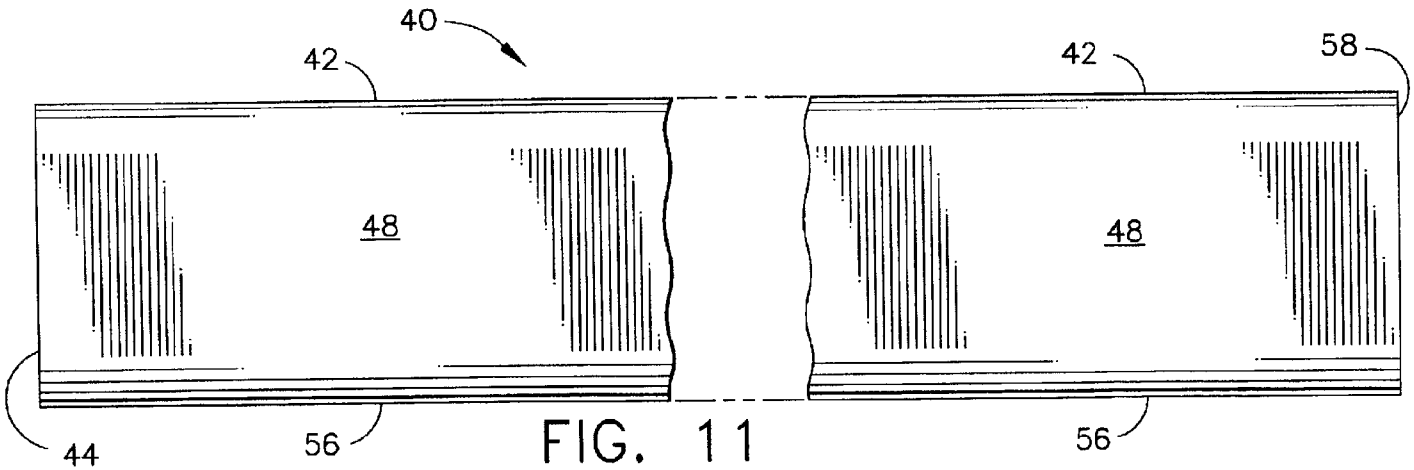
FIG. 11 is an enlarged rear elevation view of the strip magnet of FIG. 7.

FIG. 10 shows the notched longitudinal edge 46 in greater detail while directly viewing that edge. Within the concavity, the farthest extent of the depression is indicated at 50, while the outer shoulders are indicated at 52 and the inner shoulders are indicated at 54. FIG. 11 illustrates the opposite longitudinal edge 48, which in the preferred embodiment is substantially planar in shape. Edge 48 could be rounded if desired, either as a depression or a protrusion.

Figure 12:
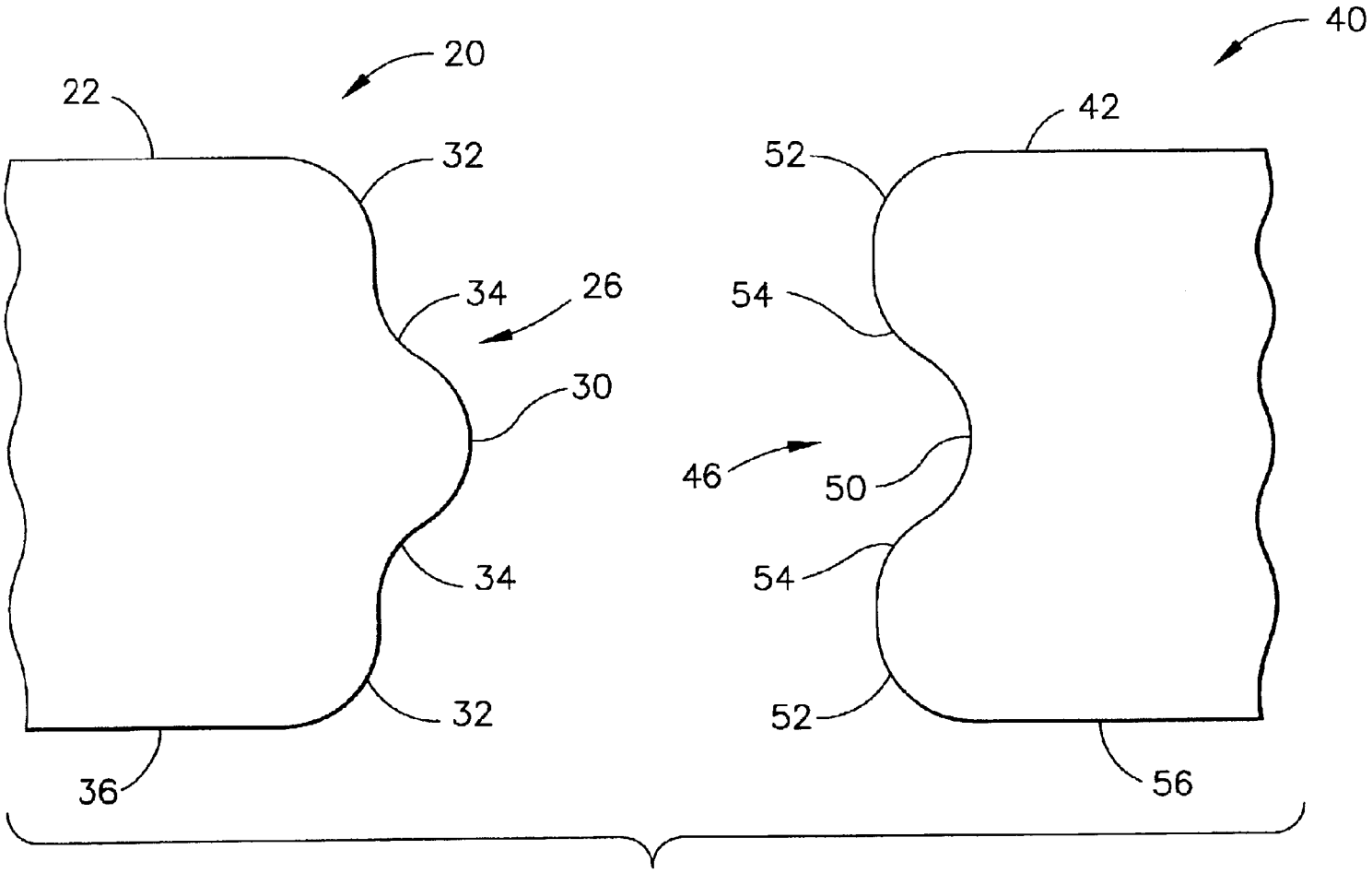
FIG. 12 is an enlarged end view in elevation of portions of the strip magnet set of FIG. 1, illustrating the mating parts along the shaped protrusion and shaped notch edges.

FIG. 12 is an enlarged view of the edge 26 of the magnetic member 20 that contains the longitudinal protrusion, oriented as it would mate to the opposite member 40 along its notched longitudinal edge 46. As can be easily seen in FIG. 12, the maximum protrusion is at the point 30 along the convex shape of the longitudinal edge 26, which preferably will mate to the maximum depression at the point 50 within the concave shape of the longitudinal edge 46. The shoulders at 52 and 54 of the notched edge 46 are preferably designed to mate against the outer shoulder 32 and the concave member 34 of the protruded edge 26 of the member 20.

By use of the notch and protrusion shapes of the present invention, the two holding magnet members 20 and 40 can be brought into close proximity or actual physical contact with one another, and the "interlocking" nature of the shapes of the notch and protrusion will act to provide some mechanical strength in addition to the magnetic attraction between these members 20 and 40. As noted above, this aids in both retaining the two magnetic members next to one another during times in which it is desired for these magnets to hold together, and will also aid in allowing very easy disassembly of the objects that are being held together by these holding magnets. Of course, any type of vertical motion (as viewed on FIG. 12) will tend to be held in substantially rigid orientation because of the protrusion and notch shapes of these longitudinal edges 26 and 46, respectively. If these holding magnets were perfectly planar along these two edges, then a vertical force would tend to shear the two magnets apart, and only their magnetic properties would be able to hold them together. With the present invention, an extra mechanical advantage will provide additional holding power so that the magnets 20 and 40 will be less likely to be forced apart due to a shear force in the vertical direction.

It will be understood that the thickness of the magnetic members 20 and 40 could be increased, if desired, so that either larger protrusions and notches could be constructed along these mating edges 26 and 46, or multiple such protrusions and notches could be constructed within these magnetic members, for example. This is all contemplated by the present inventor, and therefore falls within the principles of the present invention.

It will be understood that the longitudinal protrusion 26 could be either transverse (e.g., along the end edge 24) in orientation or could be longitudinal (as seen in FIG. 2 along edge 26), and further could exhibit a rounded shape (as in the figures) or could exhibit a planar plateau shape, or even a wedged shape.

Figure 13:
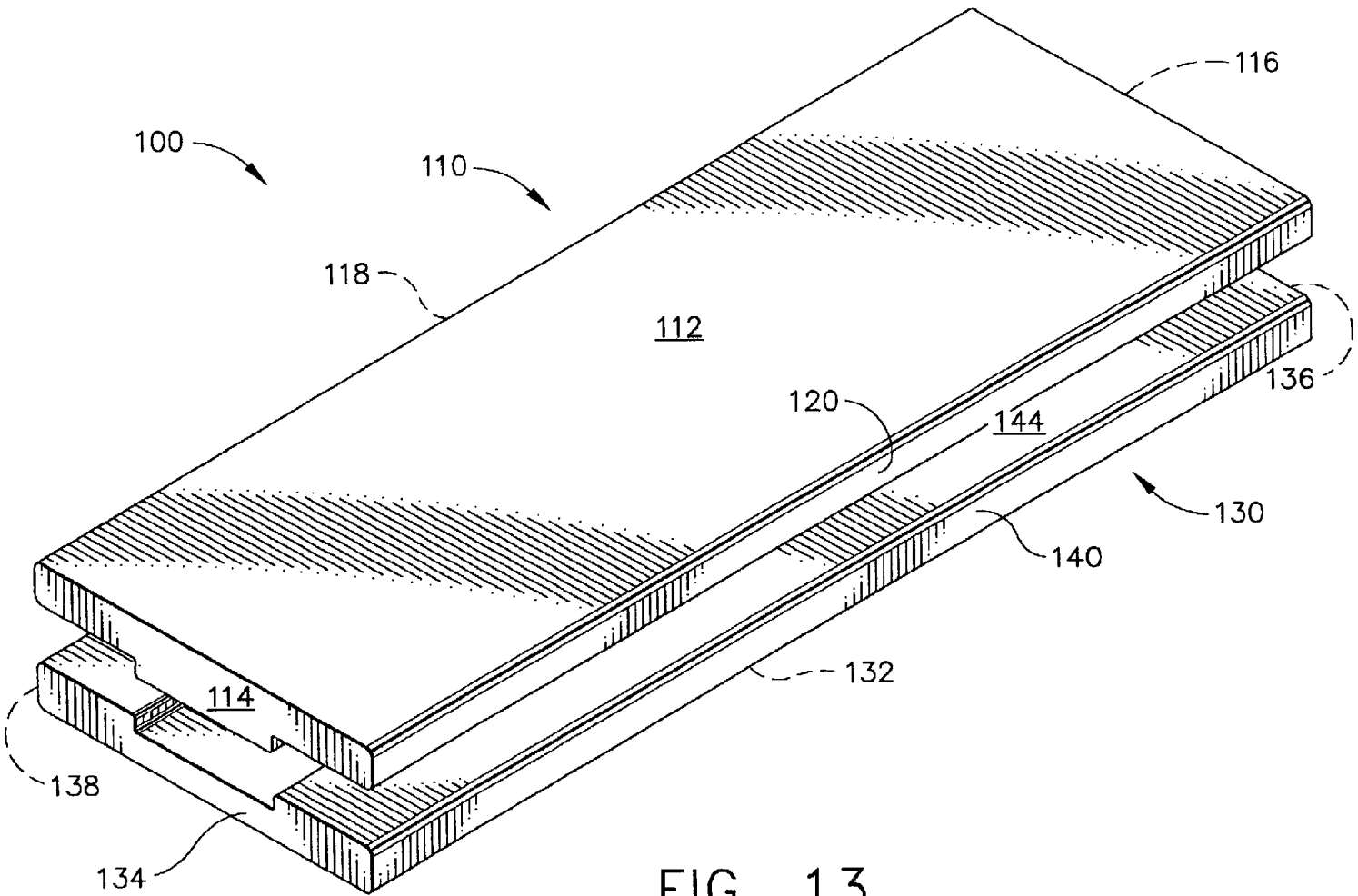
FIG. 13 is an isometric view of a strip magnet set, constructed in accordance with a second preferred embodiment of the present invention.

FIG. 13 illustrates a second embodiment of a magnet set of strip magnets, generally designated by the reference numeral 100. The top member in this view is designated by the reference numeral 110, and has a protrusion along its bottom surface (not directly viewable in FIG. 13), while the bottom member (in this view) is generally designated by the reference numeral 130, and exhibits a notch that faces the protrusion in the top member 110. The upper surface in FIG. 13 of the member 110 is illustrated at 112, as well as a left end edge 114 and a "near" longitudinal edge 120 (in this view). Not visible in this view are the right end edge 116 and the "far" longitudinal edge 118. These edges 114, 116, 118, and 120 form a perimeter about the planar surface 112.

In the bottom member 130, the left end edge 134 and the near longitudinal edge 140 are directly visible, as well as an upper surface 144 in part. Not visible in FIG. 13 are the far longitudinal edge 138 and the right-hand end edge 136, as well as the bottom surface 132.

Figure 14:
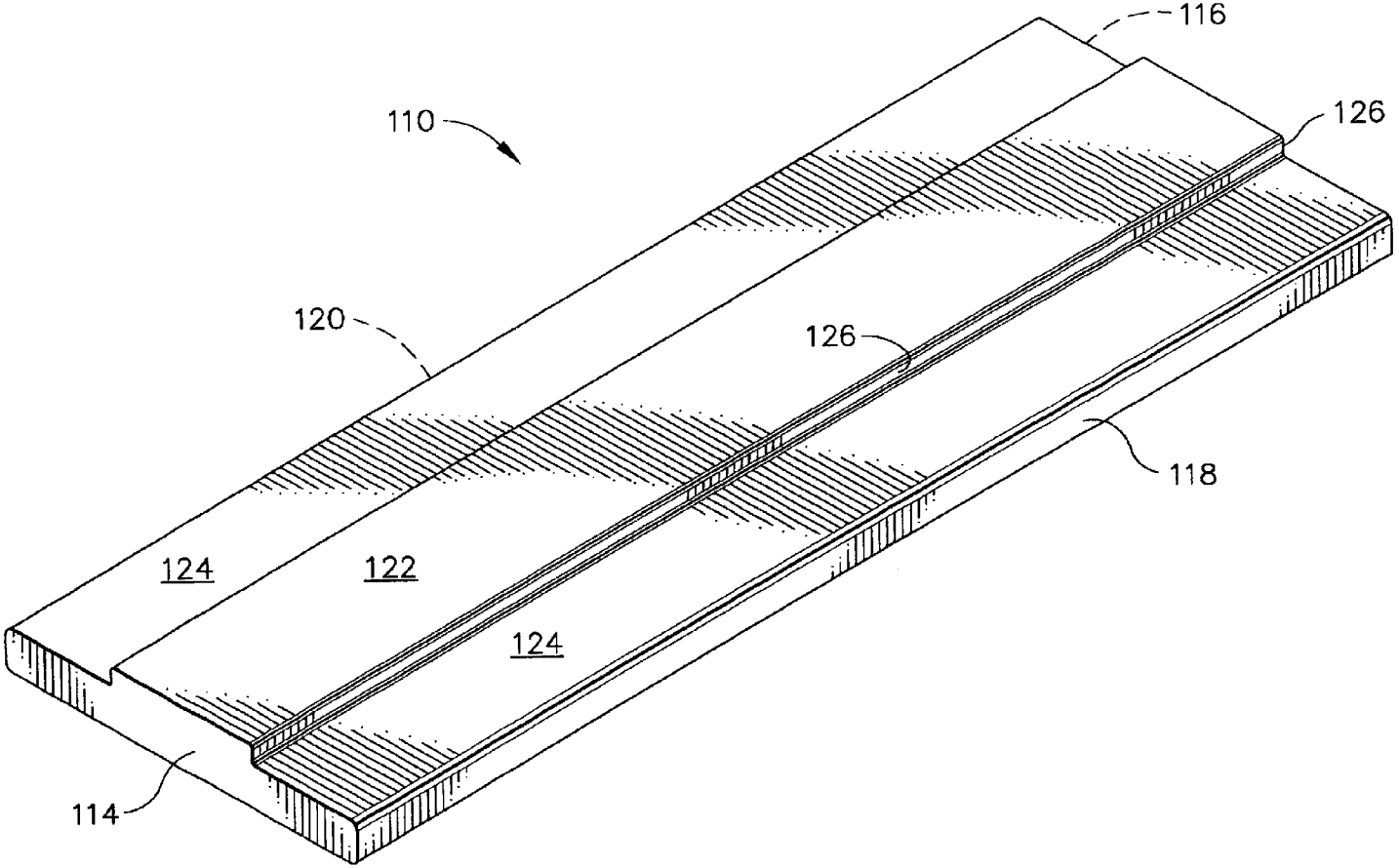
FIG. 14 is an inverted isometric view of the top member of the strip magnet set of FIG. 13, illustrating the surface having a shaped protrusion.

FIG. 14 illustrates the upper member 110 in somewhat greater detail, and also shows this member in an inverted orientation as compared to that of FIG. 13. In this new orientation, the elongated protrusion is directly visible, which is seen as the upper surface 122. It is bounded on both sides by lower planar surfaces 124, and all of these surfaces are illustrated as extending substantially along the entire length of the member 110. The transition between the "lower" planar surface 124 and the "upper" surface 122 that forms the elongated notch is made at a near-vertical relatively narrow end wall 126. By reference to "near vertical," this is with respect to the views illustrated in FIGS. 15 and 17, and also with respect to the detailed drawings which include FIG. 28. As will be described below, this transition wall 126 preferably is not exactly perpendicular to the surfaces 122 and 124, although it could have a perfectly perpendicular orientation if desired for some usage applications.

Figure 15:
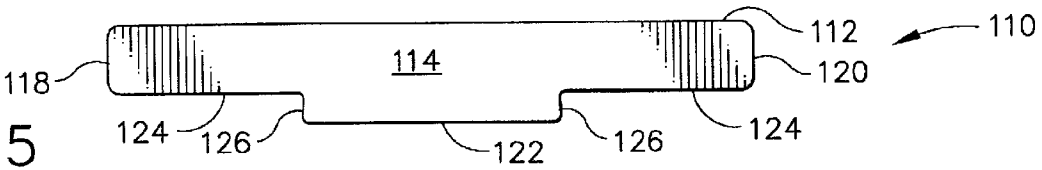
FIG. 15 is a left end elevation view of the strip magnet of FIG. 14, shown in upright disposition. The right end elevation view is identical to the left end view.

In FIG. 15, the "left" end edge 114 is directly facing the viewer, and some of the details of the shape of the protrusion are easily visible. As discussed in the previous paragraph, the transition wall at 126 is in a near-vertical orientation in this figure, which means that it is nearly perpendicular to the planar surfaces 122 and 124. Also as noted above, it is preferred that this orientation not be precisely perpendicular, and further details of this aspect of the present invention are discussed below.

Figure 16:
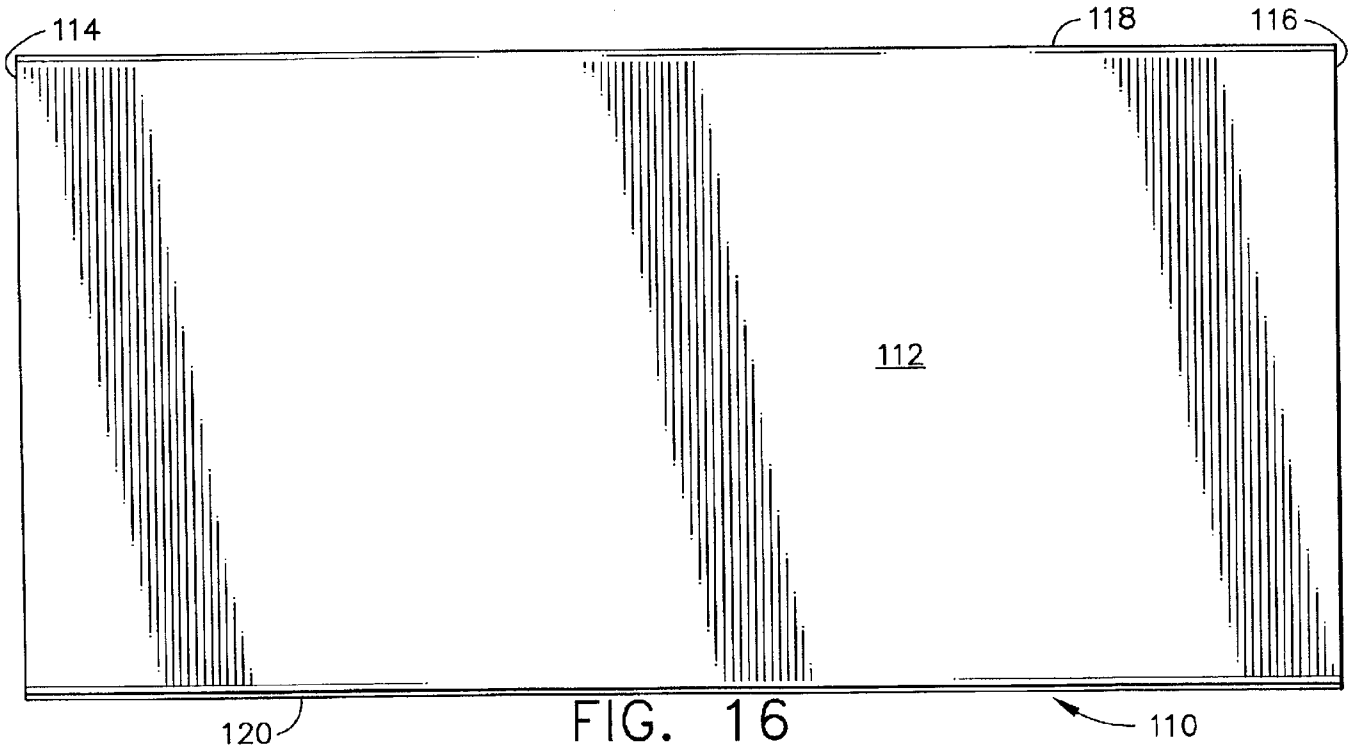
FIG. 16 is a top view of the strip magnet of FIG. 14.

FIG. 15 illustrates the "bottom" surface 112 as being substantially planar, and it should be noted that this surface 112 was the "top" surface in FIG. 13. If this magnetic member 110 is to be extruded, then the planar shape illustrated in FIG. 16 is undoubtedly the best type of surface to be made by such an extrusion process. Of course, if desired, this surface 112 does not have to be perfectly planar, or even substantially planar for that matter. Certainly, the rounded edges near the longitudinal sides 118 and 120 could be modified significantly as compared to the drawings, including that of FIG. 15. Such variations in shape are contemplated by the inventor, and thus would fall within the scope of the present invention.

FIG. 16 shows the opposite large surface of the magnetic member 110. The center member of this surface is illustrated at 122, and comprises the relatively large protrusion. Its side planar surfaces are illustrated at 124. This center protrusion has a plateau-like appearance, since it is roughly rectangular when seen from above, and also exhibits a rectangular-side profile (see FIG. 15) when considered in combination with the transition walls 126.

Figure 17:
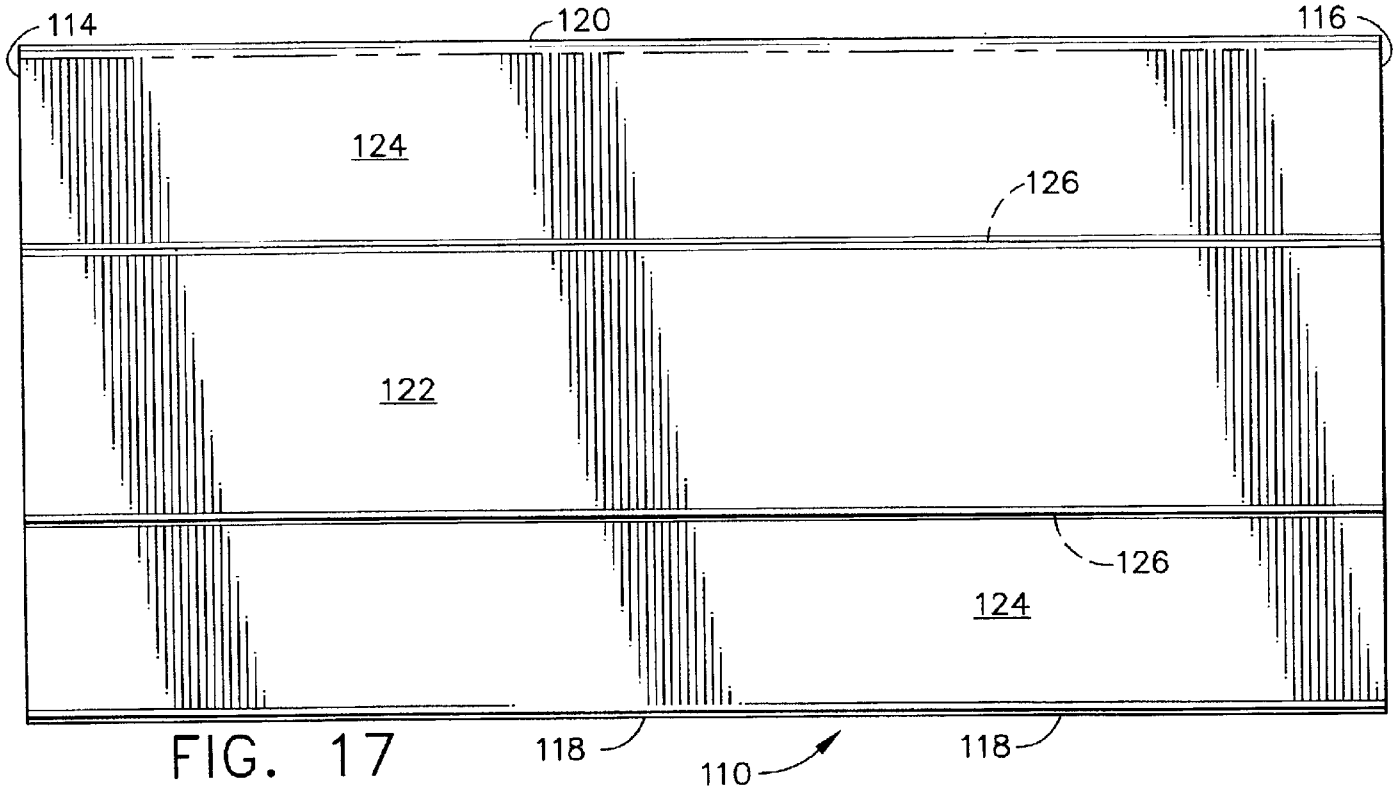
FIG. 17 is a bottom view of the strip magnet of FIG. 14, illustrating the shaped protrusion.

It will be understood that the center protrusion comprised of surfaces 122 and 126 could be either transverse in orientation or could be longitudinal (as seen in FIG. 17), and further could exhibit a planar plateau shape (as in the figures) or could exhibit a rounded shape, or even a wedged shape.

Figure 18:
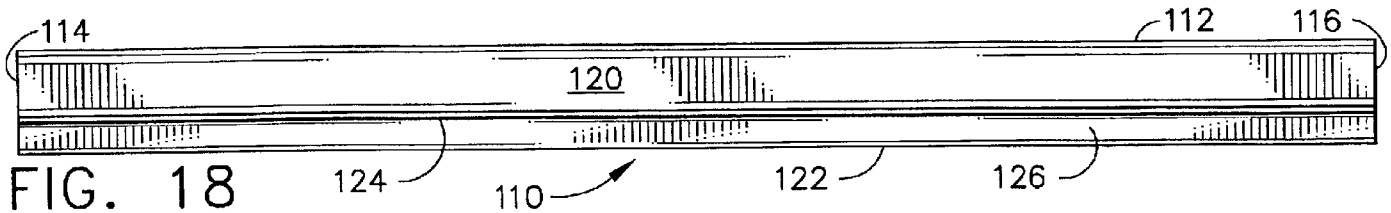
FIG. 18 is a front elevation view of the strip magnet of FIG. 14. The rear elevation view is identical to the front elevation view.

FIG. 18 is an elevational view that shows one of the longitudinal edges of the magnetic member 110. In this view, the edge 120 is directly facing the viewer. This drawing shows the "plateau" protrusion that has its furthest extended planar surface at 122, and shows the transition wall members between the surface 122 and the "lower" surface 124 as the wall 126.

Figure 19:
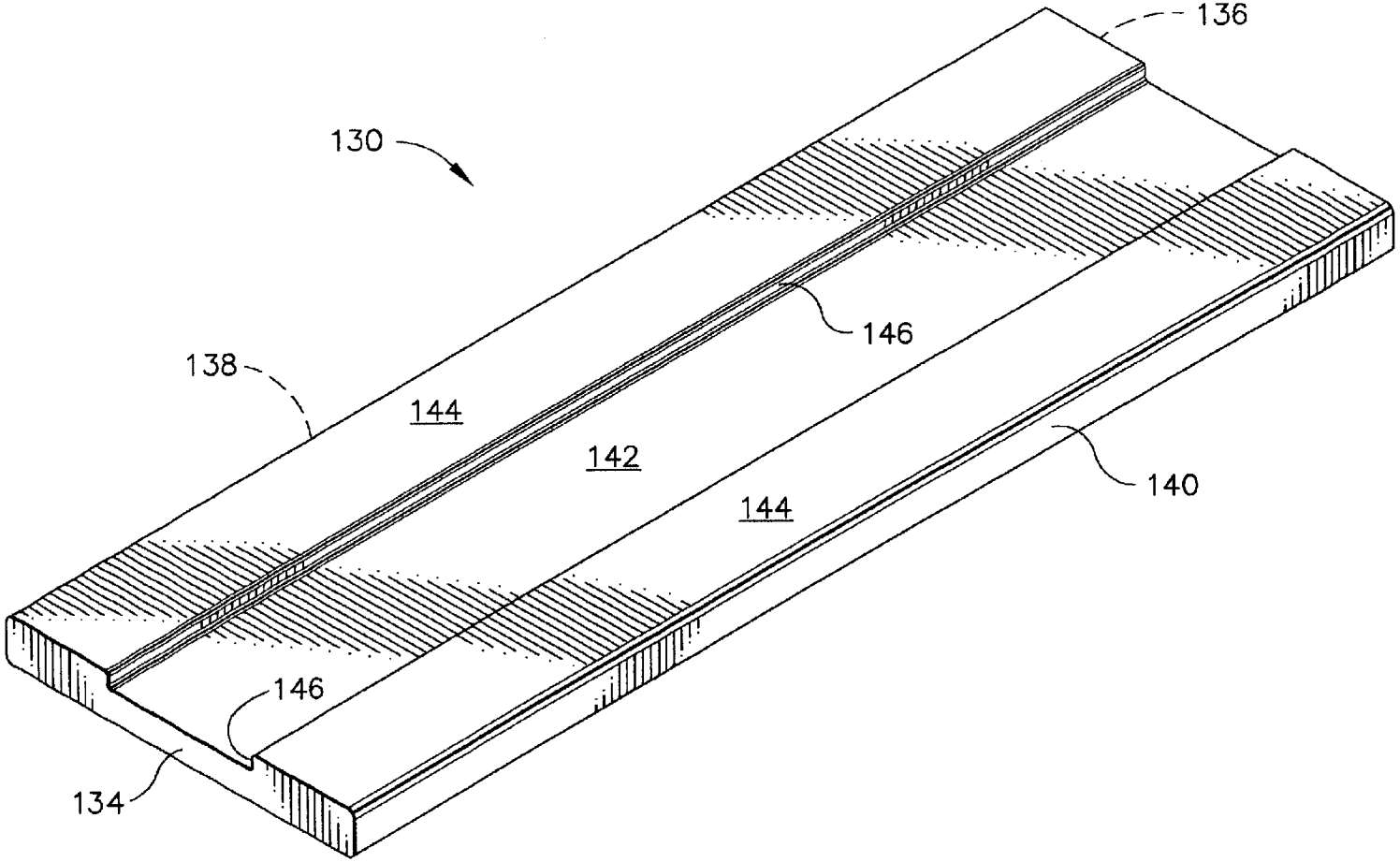
FIG. 19 is an isometric view of the bottom member of the alternative configuration of the strip magnet set of FIG. 13, illustrating the surface having a shaped large notch.

FIG. 19 shows the opposite member 130 in somewhat greater detail than visible on FIG. 13, and clearly shows its elongated notch that is formed by the surface 142 and relatively short side walls 146. In this view, the notch is formed by the planar surface 142 that is indented or depressed into this member 130 as compared to the adjacent planar surfaces 144. The elongated walls 146, of course, form the transition between the depression surface 142 and the two adjacent surfaces 144.

Figure 20:
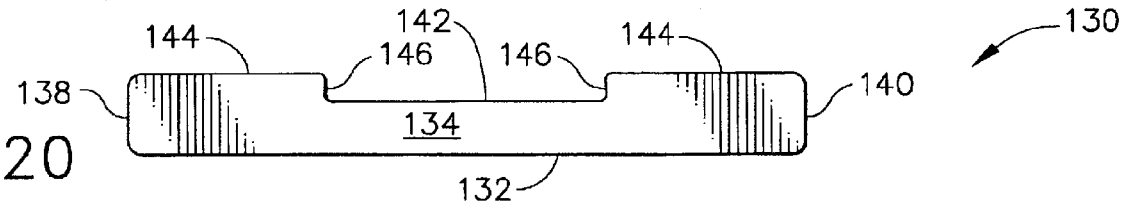
FIG. 20 is a left end elevation view of the strip magnet of FIG. 19 shown in upright disposition. The right end elevation view is identical to the left end view.

FIG. 20 is an end view of the magnetic member 130 in which the "left" end edge (of FIG. 19) 134 is directly facing the viewer. The precise shape of the depression or notch is easily discerned, in which the planar surfaces 144 and 142 are offset from one another by the transition walls 146. While these transition walls 146 could be precisely vertical in this view, it is preferred that they are not exactly vertical, and so they would preferably not be exactly perpendicular to the planar surfaces 142 and 144. This would generally correspond to the angle of the transition walls 126 between the planar surfaces 122 and 124, as clearly illustrated in FIG. 15.

The designer of the magnetic members 110 and 130 could decide that the transition walls 126 and 146 should be precisely perpendicular to the large planar surfaces that form the protrusions and notches, respectively. On the other hand, if the angle of the transition walls 126 and 146 were to be, for example, 5° from being perpendicular to the planar surfaces, then it would be best if both of these transition walls exhibited that same 5° deviation. Of course, the tolerances between these angled relatively short walls 126 and 146 could be relatively loose, depending upon how "tight" it is desired for the protrusion formed by the surface 122 and walls 126 to fit within the "notch" formed by the planar surface 142 and transition walls 146.

As noted above, an exact perpendicular relationship between the transition walls and the large planar surfaces is not necessarily desired, and further details of this construction are provided in FIGS. 28 and 29, as discussed below. By having an angular orientation as described with respect to FIGS. 28 and 29, then the protrusion of the member 110 will tend to be more likely to remain in the slot or notch of the member 130. While the members 110 and 130 are each permanent magnets, and thereby exhibit an attracting force to one another, the protrusion and notch formed in these surfaces is designed to help prevent the magnets from being separated by some type of shear force. In this instance, the shear force would be mainly in the horizontal direction with respect to FIGS. 15 and 20.

Although the protrusion and notch of the magnetic members 110 and 130, respectively, tend to help keep the magnetic members together once they are brought into close proximity to one another, these shapes are also designed for easy disassembly when the magnetic members are pulled apart in the vertical direction as seen in FIGS. 15 and 20. This allows these magnetic members 110 and 130 to be very useful to create temporary structures, such as display stands for use in consumer stores or for exhibitions and other uses.

Figure 21:
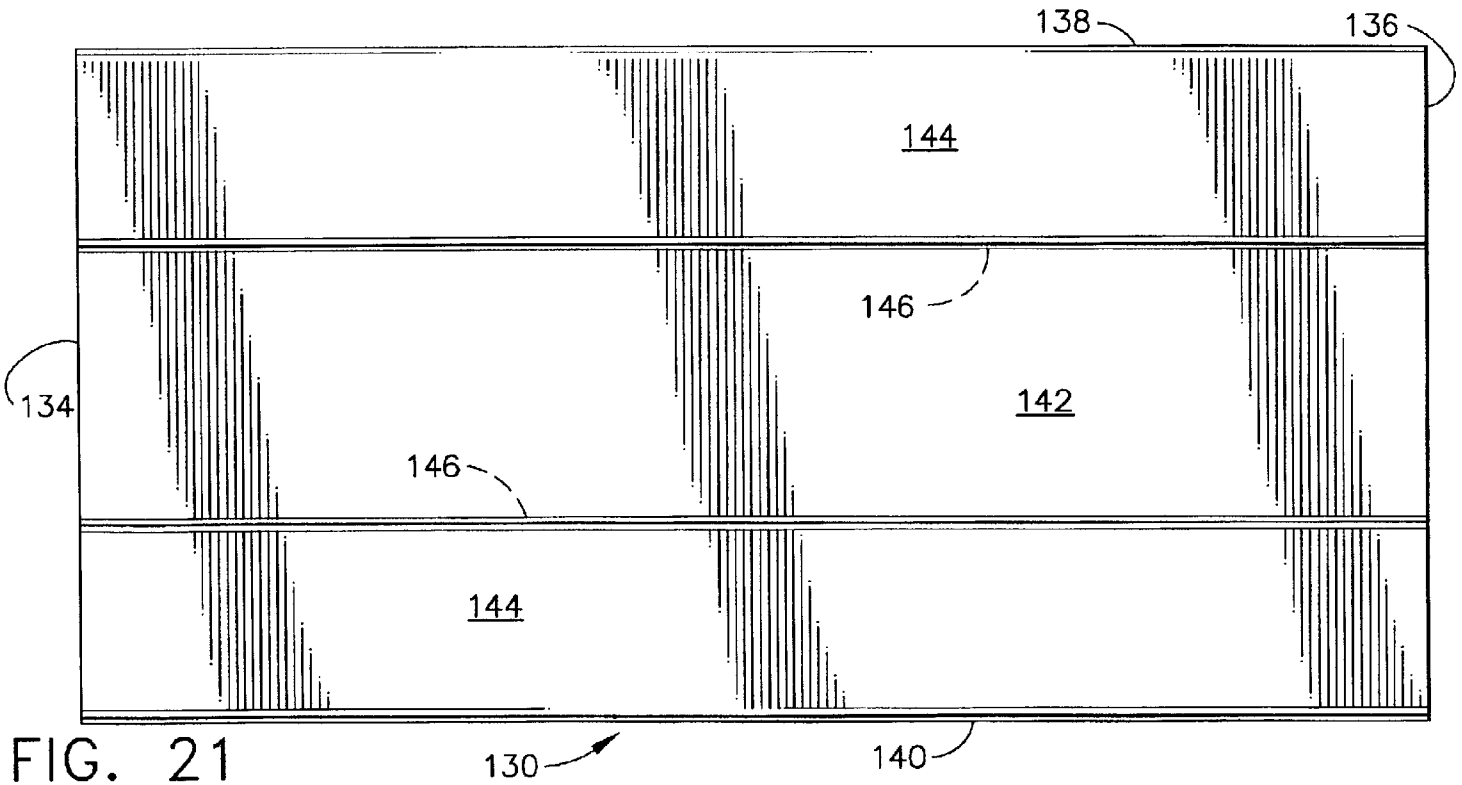
FIG. 21 is a top view of the strip magnet of FIG. 19, illustrating the shaped large notch.

It will be understood that the center depression comprised of surfaces 142 and 146 could be either longitudinal in orientation (as seen in FIG. 21), or could be transverse, and further could exhibit a planar notched shape (as in the figures), a rounded shape, or even a grooved or V-shape.

Figure 22:
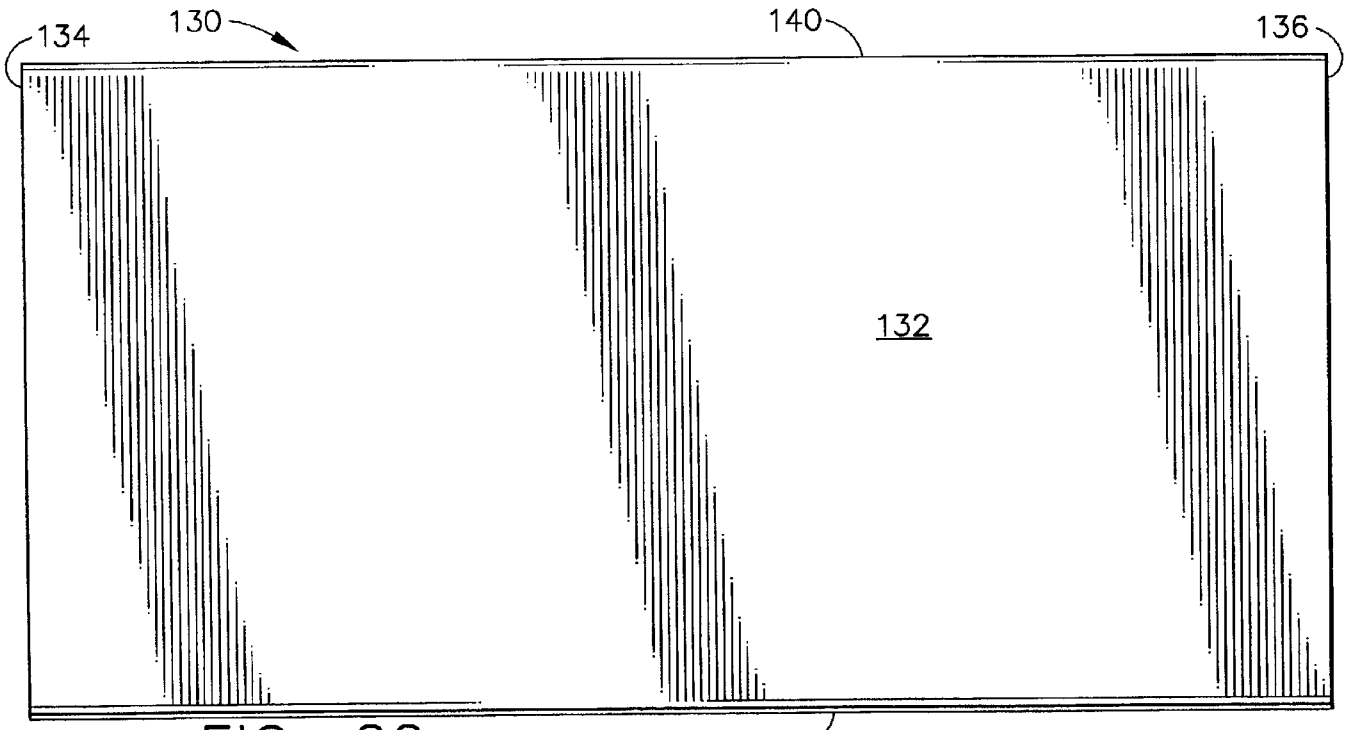
FIG. 22 is a bottom view of the strip magnet of FIG. 19.
Figure 23:
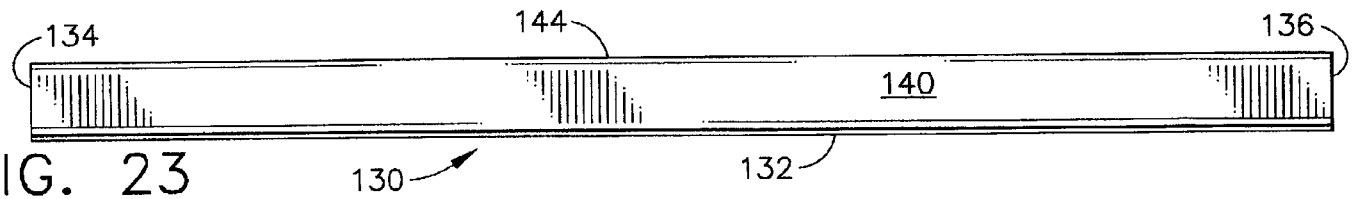
FIG. 23 is a front elevation view of the strip magnet of FIG. 19. The rear elevation view is identical to the front elevation view.

FIG. 21 illustrates the upper surfaces of the member 130, including the planar notch surface 142 and the planar adjacent surfaces 144. FIG. 22 shows the opposite surface, which is indicated by the reference numeral 132. FIG. 23 illustrates an elevational view of one of the longitudinal side edges, in this case the edge 140. On FIG. 22, the edges 134, 136, 138, and 140 form a perimeter about the planar surface 132.

Figure 24:
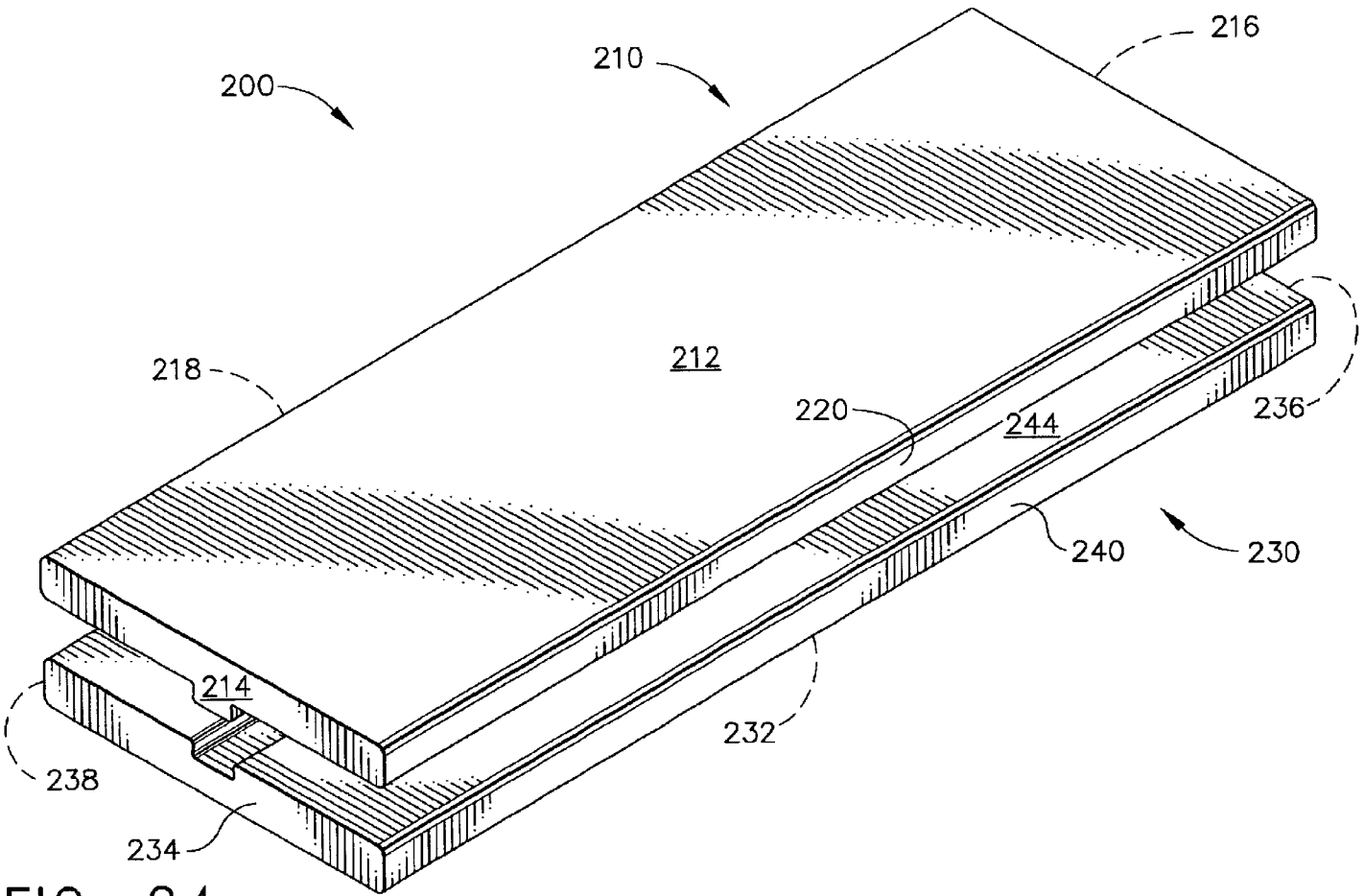
FIG. 24 is an isometric view of an alternative configuration of the strip magnet set of FIG. 13, in which the shaped protrusion and shaped notch are much narrower.

FIG. 24 illustrates an alternative construction of a set of strip magnets, generally designated by the reference numeral 200. This strip magnet set 200 is very similar to the strip magnet set 100 that is illustrated in FIG. 13. The major difference is the width of the protrusion and notch in the large planar surfaces where these two members mate together.

In FIG. 24, the top magnetic member is designated by the reference numeral 210, while the bottom member is designated by the reference numeral 230. Top member 210 has an upper surface 212 and a left end edge (in this view) 214 as well as a front (in this view) longitudinal edge 220. Not directly visible in this view are the opposite edges, including a right end edge 216 and a "far" longitudinal edge 218. Of course, the right end edge 216 is virtually identical to the left end edge 214, while the rear longitudinal edge 218 is virtually identical to the near longitudinal edge 220. On FIG.

24, the edges 214, 216, 218, and 220 form a perimeter about the planar surface 212.

The protrusion along the bottom surface (in this view) of the top member 210 is visible by inspecting the left end edge 214. As can be seen, this protrusion is much narrower in width with respect to the overall width of the member 210. A mating notch or depression is formed in the top surface of the opposite member 230, so that these two magnetic members 210 and 230 can come into direct contact with one another and act as holding magnets.

The bottom member 230 exhibits a left end edge 234, a "near" longitudinal edge 240, and an upper surface 244. Not visible in this view are the right end edge 236 (which is virtually identical to the left end edge 234), and a "far" longitudinal edge 238 (which is virtually identical to the near longitudinal edge 240). Also not visible is a bottom surface 232.

The protrusion in the bottom surface of the top member 210 and the depression/notch in the upper surface of the bottom member 230 will act precisely the same as the protrusions and depressions/notches in the previously described embodiment illustrated in FIGS. 13–23. This view of FIG. 24 is being provided to show how the shape and size of the notches and protrusions can be almost infinitely varied while remaining within the teachings of the present invention.

Figure 25:
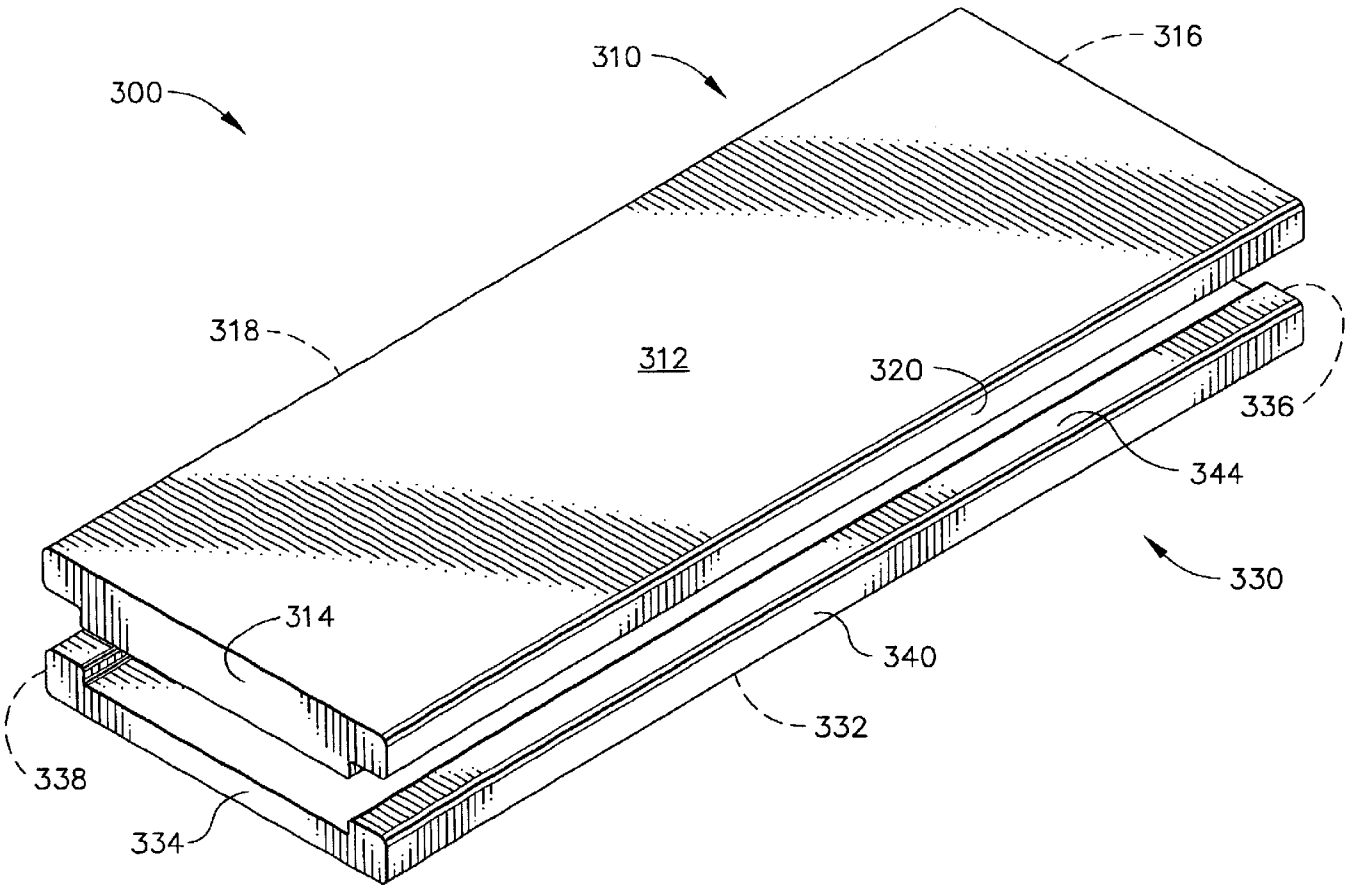
FIG. 25 is an isometric view of another alternative configuration of the strip magnet set of FIG. 13, in which the shaped protrusion and shaped notch are much wider.

FIG. 25 illustrates an alternative construction of a set of strip magnets, generally designated by the reference numeral 300. This strip magnet set 300 is very similar to the strip magnet set 100 that is illustrated in FIG. 13. The major difference is the width of the protrusion and notch in the large planar surfaces where these two members mate together.

In FIG. 25, the top magnetic member is designated by the reference numeral 310, while the bottom member is designated by the reference numeral 330. Top member 310 has an upper surface 312 and a left end edge (in this view) 314 as well as a front (in this view) longitudinal edge 320. Not directly visible in this view are the opposite edges, including a right end edge 316 and a "far" longitudinal edge 318. Of course, the right end edge 316 is virtually identical to the left end edge 314, while the rear longitudinal edge 318 is virtually identical to the near longitudinal edge 320. On FIG. 25, the edges 314, 316, 318, and 320 form a perimeter about the planar surface 312.

The protrusion along the bottom surface (in this view) of the top member 310 is visible by inspecting the left end edge 314. As can be seen, this protrusion is much wider with respect to the overall width of the member 310. A mating notch or depression is formed in the top surface of the opposite member 330, so that these two magnetic members 310 and 330 can come into direct contact with (or close proximity to) one another and act as holding magnets.

The bottom member 330 exhibits a left end edge 334, a "near" longitudinal edge 340, and an upper surface 344. Not visible in this view are the right end edge 336 (which is virtually identical to the left end edge 334), and a "far" longitudinal edge 338 (which is virtually identical to the near longitudinal edge 340). Also not visible is a bottom surface 332.

The protrusion in the bottom surface of the top member 310 and the depression/notch in the upper surface of the bottom member 330 will act precisely the same as the protrusions and depressions/notches in the previously described embodiment illustrated in FIGS. 13–23. This view of FIG. 24 is being provided to show how the shape and size of the notches and protrusions can be almost infinitely varied while remaining within the teachings of the present invention.

Figure 26:
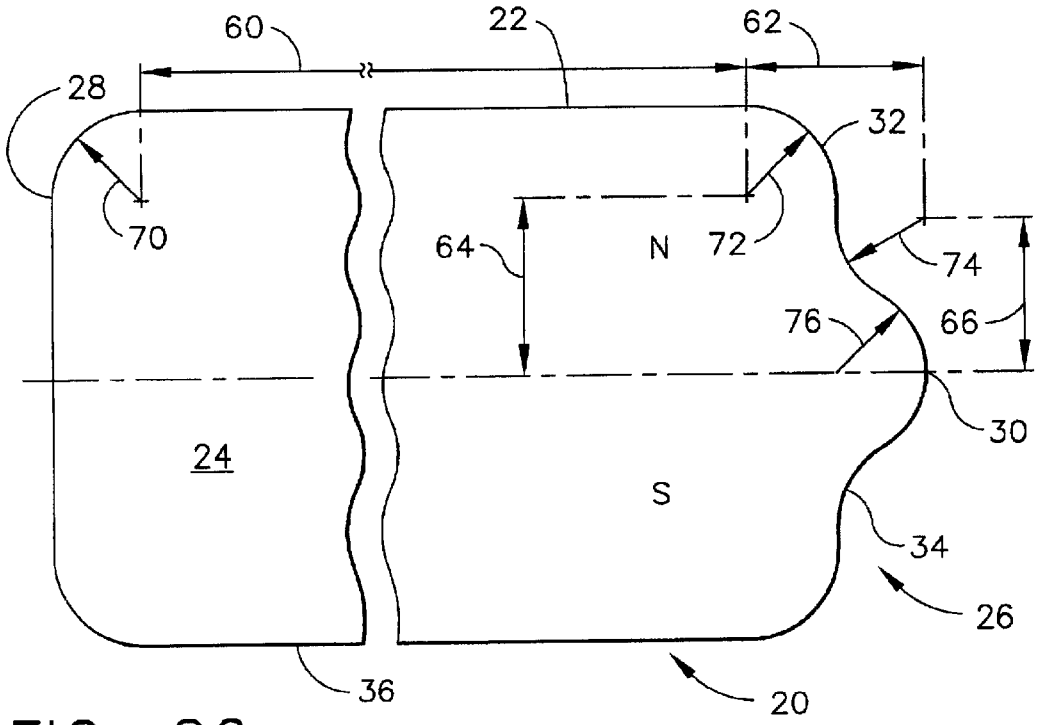
FIG. 26 is a foreshortened end elevation view of the left-hand member of the first preferred embodiment of FIG. 1, illustrating dimensional features thereof.

FIG. 26 provides some exemplary dimensions for the strip magnet member 20, and also illustrates the magnetization of this strip magnet by the North Pole at the letter "N," which is on the upper half of the strip magnet, whereas the South Pole is indicated at the letter "S" which is at the lower half of the strip magnet 20. As can be seen from FIG. 26, the rounded shapes that make up the protrusion 30 of the shaped edge 26 comprise individual radii, as indicated at the reference numerals 72, 74, and 76. In the preferred mode of the invention, all of these radii are equal to one another, although that certainly does not have to be the case to make an extrudable strip magnet within the scope of the present invention.

The other radius indicated is for the corners on the far end 28 of the strip magnet 20. These radii comprise the corners along the planar end 28 and the planar top and bottom surfaces 22 and 36, and the radius 70 is indicative of one of these radii. In the preferred mode of the invention, this radius 70 is equal in distance to the radii 72, 74, and 76.

It will be understood that the length, width, and height of the strip magnet 20 can be virtually any dimensions desired by a magnet designer, as well as the curved features that make up individual radii in the illustrated embodiment of FIG. 26. A list of exemplary dimensions will now be provided for a particular strip magnet that has been constructed by the inventor. For the radii 70, 72, 74, and 76, the distance is about 0.0097 inches. For the main width dimension 60, 0.256 inches; for the width dimension 62, 0.0194 inches; for the height dimension 66 from the centerline to the center of the radius 74, 0.0168 inches; and for the height dimension 64, 0.0194 inches.

Figure 27:
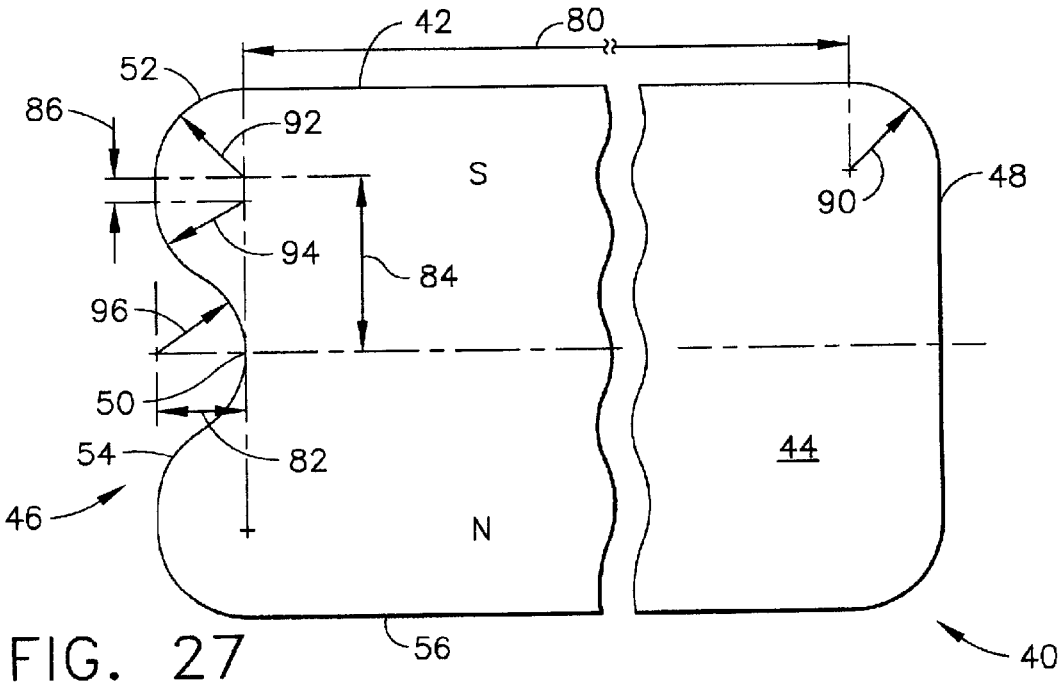
FIG. 27 is a foreshortened end elevation view of the right-hand member of the first preferred embodiment of FIG. 1, illustrating dimensional features thereof.

FIG. 27 illustrates a similar view of exemplary dimensions for the magnetic member 40 that has the shaped rounded notch along the notched longitudinal edge 46. In this case, the magnetic polarities are opposite, i.e., the South Pole at "S" is on the top member of the strip magnet 40, while the North Pole at "N" is on the bottom member of this strip magnet. Once again, the radii are preferably identical, however, in this case the radius dimension is 0.0097 inches for the radii 90, 92, 94, and 96. Of course, this could be changed, and for that matter, some of these curved shapes could be parabolic or ellipsoidal, for example.

The linear dimensions are also provided as an exemplary set of dimensions that will match those dimensions provided for FIG. 26. The main width dimension 80 is 0.256 inches, while the width dimension 82 (which essentially determines the depth of the notch) is 0.0097 inches. The height dimension 84 is 0.0194 inches. Of course, all of these length, width, and height dimensions could be changed to virtually any size for a strip magnet, as desired by the magnet designer.

It will be understood that the length, width, and height dimensions of the strip magnets 20 and 40 can be virtually any distances desired by the magnetic designer, and that the tolerances involved can also be relatively tight or loose depending upon the application that is in mind for these holding magnets. The radii and distance relationships between the notch 46 or protrusion 26 can be fairly precise, or could have looser tolerances if desired. It really depends upon how much mechanical shear force is to be withstood by forces along the vertical with respect to FIGS. 26 and 27, and how "easy" it will be to mate the magnets together into a holding relationship.

Figure 28:
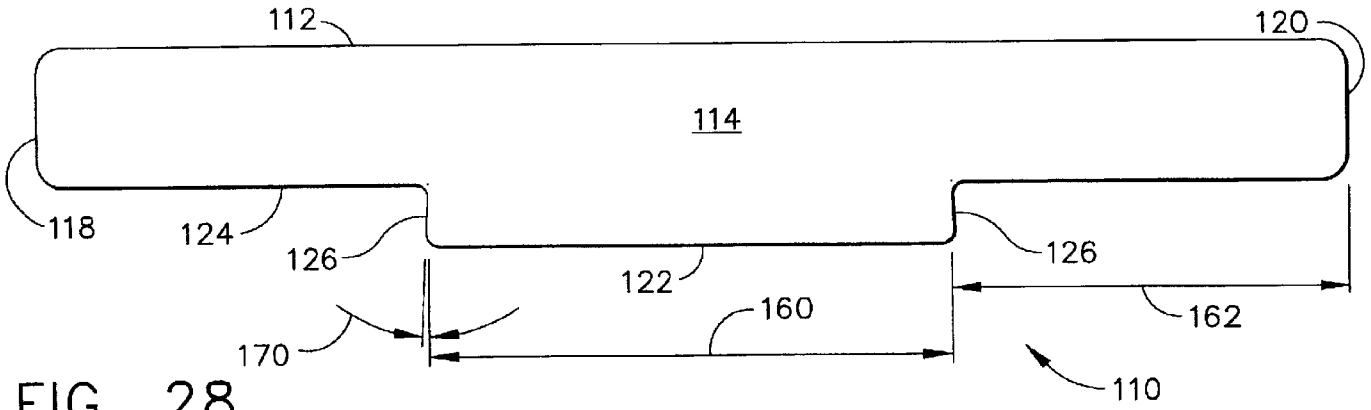
FIG. 28 is an enlarged end elevation view of the top member of the second preferred embodiment shown in FIG. 13, illustrating dimensional features thereof.

FIG. 28 illustrates some exemplary dimensions of the strip magnet member 110, including a width dimension 160 of the protrusion made up by the planar surface 122 and the "short" elongated walls 126. The angle 170 is also given, and as noted above, is somewhat different than perpendicular between the surface 126 and the surface 124.

In one preferred set of dimensions, the width dimension 160 is 0.206 inches, while the width dimension 162 is 0.151 inches. The angle 170 is about 3°.

Figure 29:
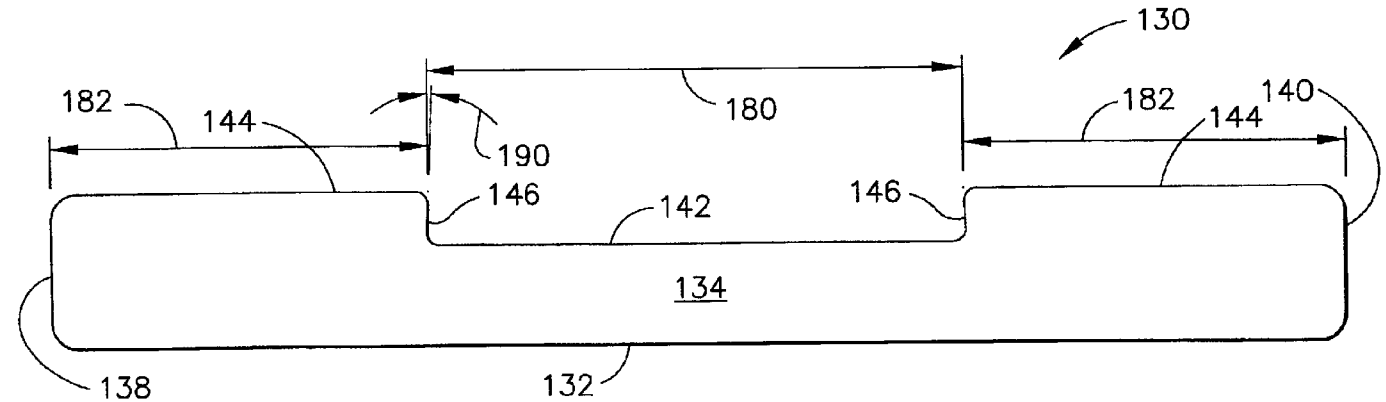
FIG. 29 is an enlarged end elevation view of the bottom member of the second preferred embodiment shown in FIG. 13, illustrating dimensional features thereof.

FIG. 29 give exemplary dimensions for the opposite magnetic member 130, including the width dimension 180 that essentially determines the width of the relatively wide planar notch made up by the surface 142 and the side walls 146. This dimension is 0.210 inches. The dimension 182 is 0.1485 inches, while the angle 190 is about 3°.

It will be understood that the length, width, and height dimensions of the strip magnets 110 and 130 can be virtually any distances desired by the magnetic designer, and that the tolerances involved can also be relatively tight or loose depending upon the application that is in mind for these holding magnets. The angle 170 does not necessarily have to be equal to the angle 190, although that is preferred. Moreover, the angles and distance relationships between the width of the slot or protrusions at 122 and 142 can be fairly precise, or could have looser tolerances if desired. It really depends upon how much mechanical shear force is to be withstood by forces along the horizontal with respect to FIGS. 28 and 29, and how "easy" it will be to mate the magnets together into a holding relationship.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A set of permanent magnets, comprising:

a first substantially rectangular permanent magnet having a first substantially planar surface and a second, opposite substantially planar surface, a first edge, a second edge, a third edge, and a fourth edge which form a perimeter about said first and second surfaces;

a second substantially rectangular permanent magnet having a third substantially planar surface and a fourth, opposite substantially planar surface, a fifth edge, a sixth edge, a seventh edge, and an eighth edge which form a perimeter about said third and fourth surfaces;

said first magnet exhibiting at least one protrusion along at least a portion of said first edge; and said second magnet exhibiting at least one depression along at least a portion of said fifth edge;

wherein said at least one protrusion and said at least one depression are sized and shaped so as to mechanically mate with one another when said first magnet is placed proximal to said second magnet in a manner that orients said first edge with said fifth edge.

2. The permanent magnets as recited in claim 1, wherein said at least one protrusion and said at least one depression tend to increase a shear force capability of said set of permanent magnets, and also assist in guiding said first and second permanent magnets into a proper orientation as they are brought into close proximity to one another.

3. The permanent magnets as recited in claim 1, wherein said first edge comprises a longitudinal edge of said first permanent magnet, and said fifth edge comprises a longitudinal edge of said second permanent magnet.

4. The permanent magnets as recited in claim 3, wherein said first and second permanent magnets exhibit a shape that is extrudable.

5. The permanent magnets as recited in claim 1, wherein said first edge comprises a transverse edge of said first permanent magnet, and said fifth edge comprises a transverse edge of said second permanent magnet.

6. The permanent magnets as recited in claim 1, wherein said at least one protrusion exhibits a substantially constant size and shape along substantially the entire linear distance of said first edge, and said at least one depression exhibits a substantially constant size and shape along substantially the entire linear distance of said fifth edge.

7. The permanent magnets as recited in claim 6, wherein said at least one protrusion exhibits a rounded shape having a single major convex extension substantially along a centerline of said first edge, and said at least one depression exhibits a rounded shape having a single major concave depression substantially along a centerline of said fifth edge.

8. The permanent magnets as recited in claim 6, wherein said at least one protrusion exhibits a plateau shape having a single major planar extension substantially along a centerline of said first edge, and said at least one depression exhibits a flattened valley shape having a single major planar notch substantially along a centerline of said fifth edge.

9. The permanent magnets as recited in claim 6, wherein said at least one protrusion exhibits a wedge shape having a single major extension substantially along a centerline of said first edge, and said at least one depression exhibits a grooved shape having a single major V-notch substantially along a centerline of said fifth edge.

10. The permanent magnets as recited in claim 1, wherein said at least one protrusion is segmented such that its size or shape varies along the linear distance of said first edge, and said at least one depression is correspondingly segmented such that its size or shape varies along the linear distance of said fifth edge.

11. A set of permanent magnets, comprising:

a first substantially rectangular permanent magnet having a first substantially planar surface and a second, opposite substantially planar surface, a first edge, a second edge, a third edge, and a fourth edge which form a perimeter about said first and second surfaces;

a second substantially rectangular permanent magnet having a third substantially planar surface and a fourth, opposite substantially planar surface, a fifth edge, a sixth edge, a seventh edge, and an eighth edge which form a perimeter about said third and fourth surfaces;

said first magnet exhibiting at least one protrusion along at least a portion of said first surface; and said second magnet exhibiting at least one depression along at least a portion of said third surface;

wherein said at least one protrusion and said at least one depression are sized and shaped so as to mechanically mate with one another when said first magnet is placed proximal to said second magnet in a manner that orients said first surface with said third surface, thereby increasing a shear force capability of said set of permanent magnets; and wherein, after being mated together, said set of permanent magnets are readily detachable from one another, into separate components comprising said first magnet and said second magnet.

12. The permanent magnets as recited in claim 11, wherein said at least one protrusion and said at least one depression tend to increase a shear force capability of said set of permanent magnets, and also assist in guiding said first and second permanent magnets into a proper orientation as they are brought into close proximity to one another.

13. A set of permanent magnets, comprising:

a first substantially rectangular permanent magnet having a first substantially planar surface and a second, opposite substantially planar surface, a first edge, a second edge, a third edge, and a fourth edge which form a perimeter about said first and second surfaces;

a second substantially rectangular permanent magnet having a third substantially planar surface and a fourth, opposite substantially planar surface, a fifth edge, a sixth edge, a seventh edge, and an eighth edge which form a perimeter about said third and fourth surfaces;

said first magnet exhibiting at least one protrusion along at least a portion of said first surface; and said second magnet exhibiting at least one depression along at least a portion of said third surface;

wherein said at least one protrusion and said at least one depression are sized and shaped so as to mechanically mate with one another when said first magnet is placed proximal to said second magnet in a manner that orients said first surface with said third surface, thereby increasing a shear force capability of said set of permanent magnets; and wherein said at least one protrusion runs in a substantially longitudinal direction along said first surface, and said at least one depression runs in a substantially longitudinal direction along said fifth surface.

14. The permanent magnets as recited in claim 13, wherein said first and second permanent magnets exhibit a shape that is extrudable.

15. The permanent magnets as recited in claim 11, wherein said at least one protrusion runs in a substantially transverse direction along said first surface, and said at least one depression runs in a substantially transverse direction along said fifth surface.

16. A set of permanent magnets, comprising:

a first substantially rectangular permanent magnet having a first substantially planar surface and a second, opposite substantially planar surface, a first edge, a second edge, a third edge, and a fourth edge which form a perimeter about said first and second surfaces;

a second substantially rectangular permanent magnet having a third substantially planar surface and fourth, opposite substantially planar surface, a fifth edge, a sixth edge, a seventh edge, and an eighth edge which form a perimeter about said third and fourth surfaces;

said first magnet exhibiting at least one protrusion along at least a portion of said first surface; and said second magnet exhibiting at least one depression along at least a portion of said third surface;

wherein said at least one protrusion and said at least one depression are sized and shaped so as to mechanically mate with one another when said first magnet is placed proximal to said second magnet in a manner that orients said first surface with said third surface, thereby increasing a shear force capability of said set of permanent magnets; and wherein said at least one protrusion exhibits a substantially constant size and shape along substantially the entire linear distance of said first surface, and said at least one depression exhibits a substantially constant size and shape along substantially the entire linear distance of said third surface.

17. The permanent magnets as recited in claim 16, wherein said at least one protrusion exhibits a rounded shape having a single major convex extension substantially along a centerline of said first surface, and said at least one depression exhibits a rounded shape having a single major concave depression substantially along a centerline of said third surface.

18. The permanent magnets as recited in claim 16, wherein said at least one protrusion exhibits a plateau shape having a single major planar extension substantially along a centerline of said first surface, and said at least one depression exhibits a flattened valley shape having a single major planar notch substantially along a centerline of said third surface.

19. The permanent magnets as recited in claim 16, wherein said at least one protrusion exhibits a wedge shape having a single major extension substantially along a centerline of said first surface, and said at least one depression exhibits a grooved shape having a single major V-notch substantially along a centerline of said third surface.

20. The permanent magnets as recited in claim 11, wherein said at least one protrusion is segmented such that its size or shape varies along the linear distance of said first surface, and said at least one depression is correspondingly segmented such that its size or shape varies along the linear distance of said third surface.

* * * * *

UNITED STATES PATENT AND TRADEMARK OFFICE

CERTIFICATE OF CORRECTION

PATENT NO. : 6,747,537 B1
APPLICATION NO. : 10/157532
DATED : June 8, 2004
INVENTOR(S) : Larry A. Mosteller It is certified that error appears in the above-identified patent and that said Letters Patent is hereby corrected as shown below:

In claim 16, column 14, line 2, insert --a-- before “fourth”.

Signed and Sealed this

Twenty-second Day of May, 2007

JON W. DUDAS
*Director of the United States Patent and Trademark Office*